United States Patent [19]

Livingston et al.

[11] Patent Number: 4,756,321

[45] Date of Patent: Jul. 12, 1988

[54] INDUSTRIAL DISHWASHER CHEMICAL DISPENSER

[75] Inventors: James W. Livingston; Stephen G. Hosking, both of Santa Cruz, Calif.

[73] Assignee: Beta Technology, Inc., Santa Cruz, Calif.

[21] Appl. No.: 800,661

[22] Filed: Nov. 22, 1985

[51] Int. Cl.[4] ..... B08B 3/02

[52] U.S. Cl. ..... 134/56 D; 134/94; 68/207; 68/12 R; 222/56

[58] Field of Search ..... 134/56 D, 58 D, 57 D, 134/94; 68/207, 17 R, 12 R, 13 R; 222/56

[56] References Cited

U.S. PATENT DOCUMENTS

| | | | |
|---|---|---|---|
| 2,696,822 | 12/1954 | Lathrop et al. | 134/115 R |
| 2,859,760 | 11/1958 | Borell | 134/57 DX |
| 3,013,568 | 12/1961 | Getchell et al. | 134/56 D |
| 3,478,757 | 11/1969 | Tuthill | 134/57 D |
| 3,490,467 | 1/1970 | Gore | 134/18 |
| 3,796,925 | 3/1974 | Breeding | 134/57 D X |
| 4,249,573 | 2/1981 | Chevallier | 134/57 D X |
| 4,463,582 | 8/1984 | Saalmann et al. | 134/57 D |

FOREIGN PATENT DOCUMENTS

| | | | |
|---|---|---|---|
| 614329 | 7/1978 | U.S.S.R. | 222/59 |

*Primary Examiner*—Harvey C. Hornsby
*Assistant Examiner*—Frankie L. Stinson
*Attorney, Agent, or Firm*—Flehr, Hohbach, Test, Albritton & Herbert

[57] ABSTRACT

A chemical dispenser and controller for industrial dishwashers. The level of detergent concentration in the dishwasher wash water is measured in logarithmically scaled unit, and the target detergent concentration level is specified in similar units. The dishwasher's controller converts wash water conductivity measurements into logarithmically scaled detergent concentration measurements. The unit of measurement for these logarithmically scaled measurements are called "Beta" units. The controller also monitors the detergent concentration level and generates an alarm if the measured detergent concentration fails to increase by at least a predefined amount while the detergent feeding mechanism is turned on. Another feature of the controller is that it generates an alarm if the measured detergent concentration fails to reach its target level after the detergent feeding mechanism has been on for a predetermined time period. Further, the controller includes different control strategies for conveyor and batch type dishwashers, including a control method for conserving rinse agent and detergent in batch type dishwashers.

8 Claims, 16 Drawing Sheets

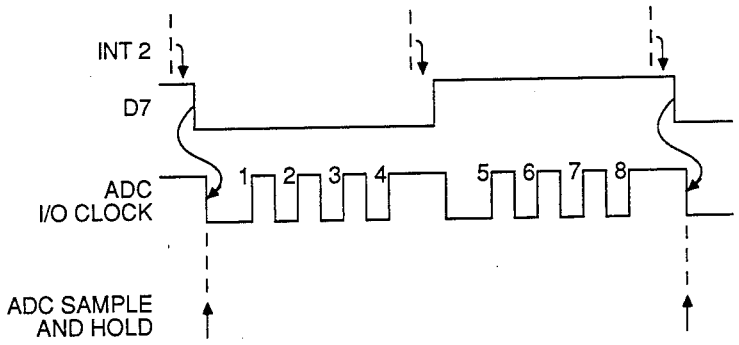
*FIGURE 2A PROBE MEASUREMENT TIMING*
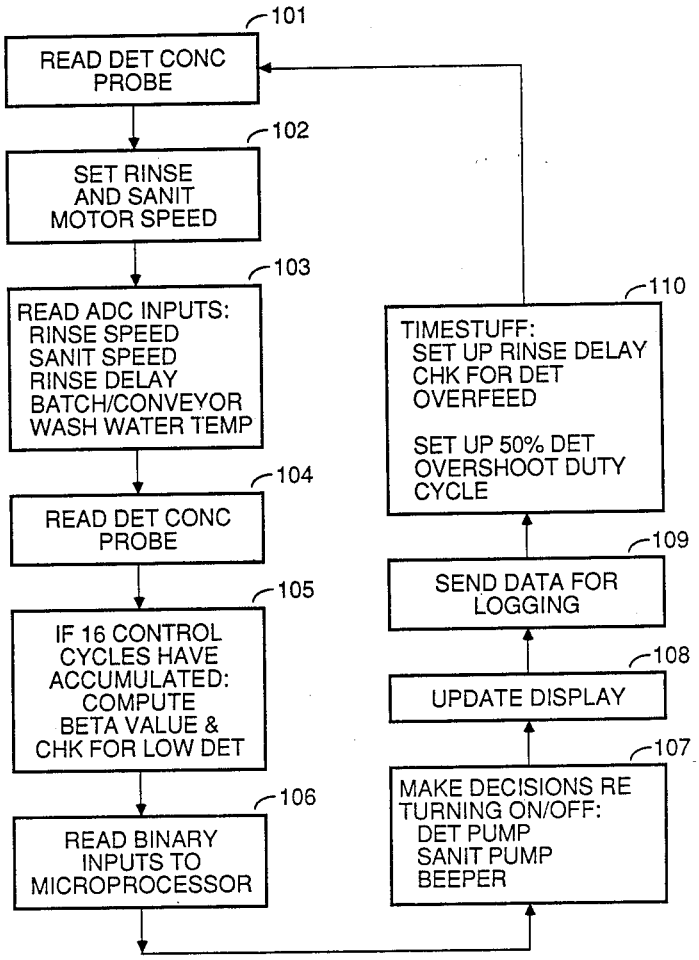
*FIGURE 3 CONTROLLER FLOWCHART*

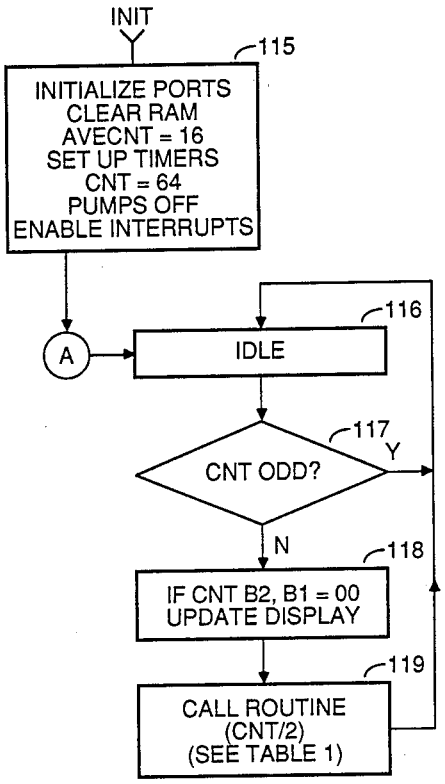
*FIGURE 4 EXEC LOOP*

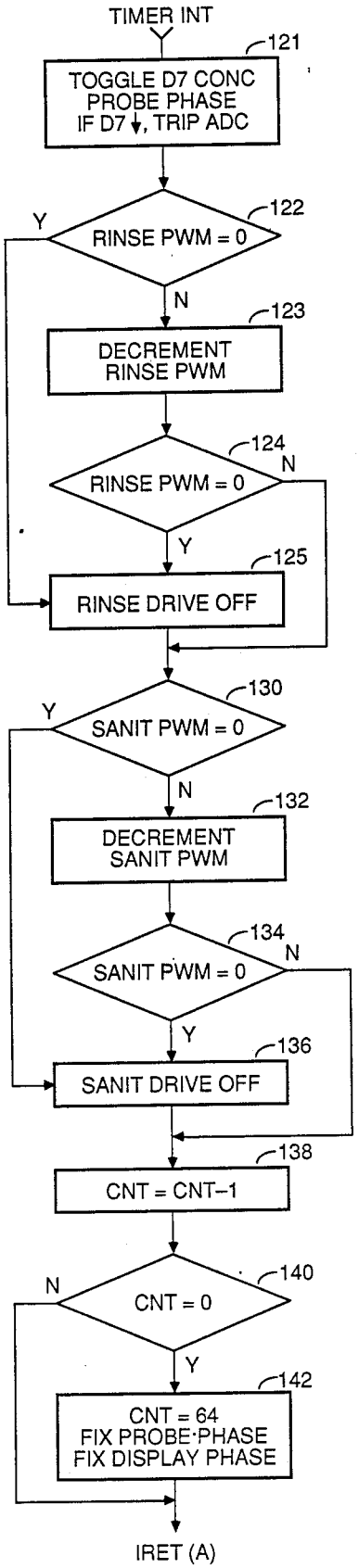
*FIGURE 5 TIMER*

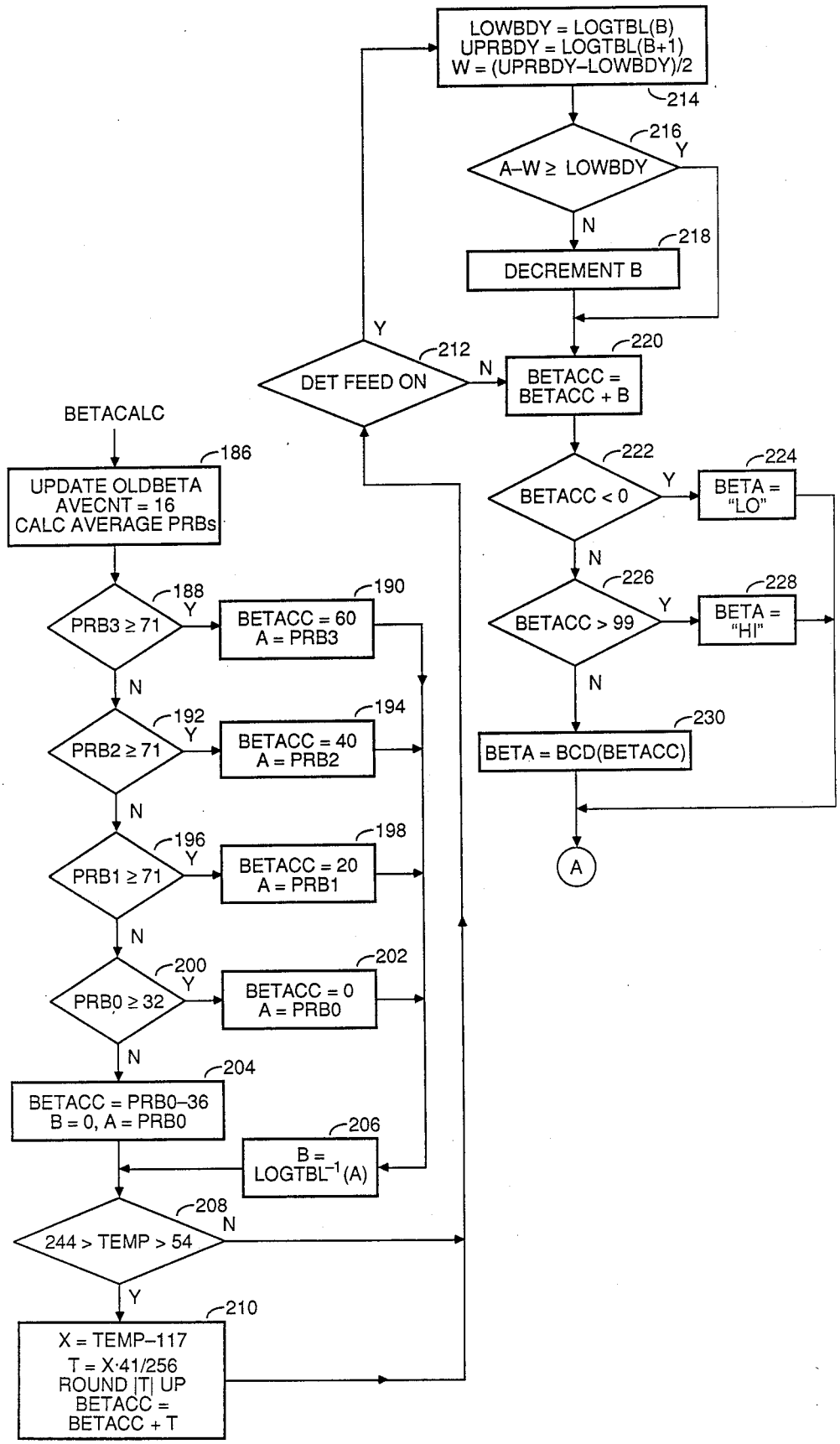
*FIGURE 12 BETAUNIT*

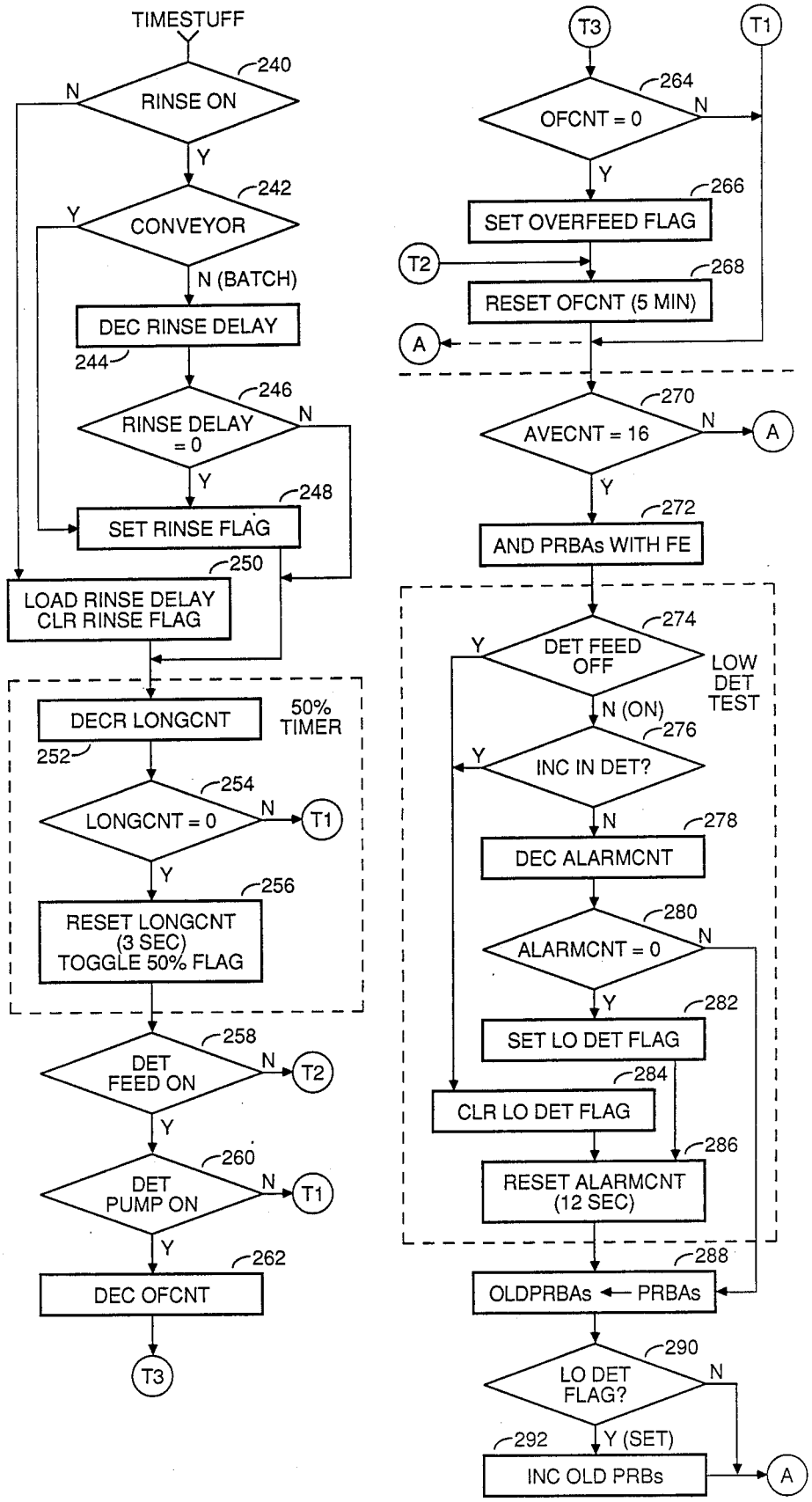
*FIGURE 13 TIMESTUFF*

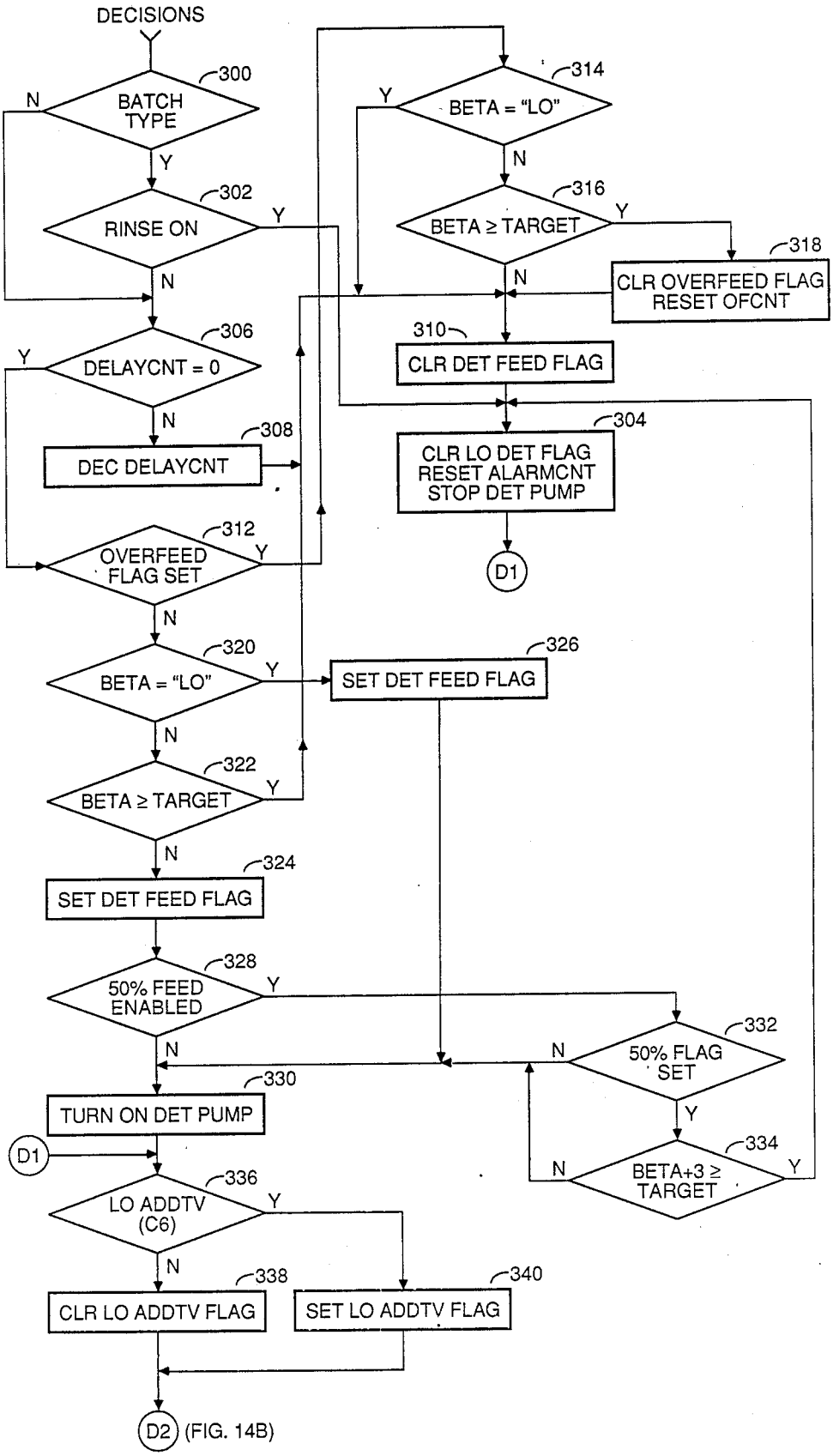
*FIGURE 14A DECISIONS*

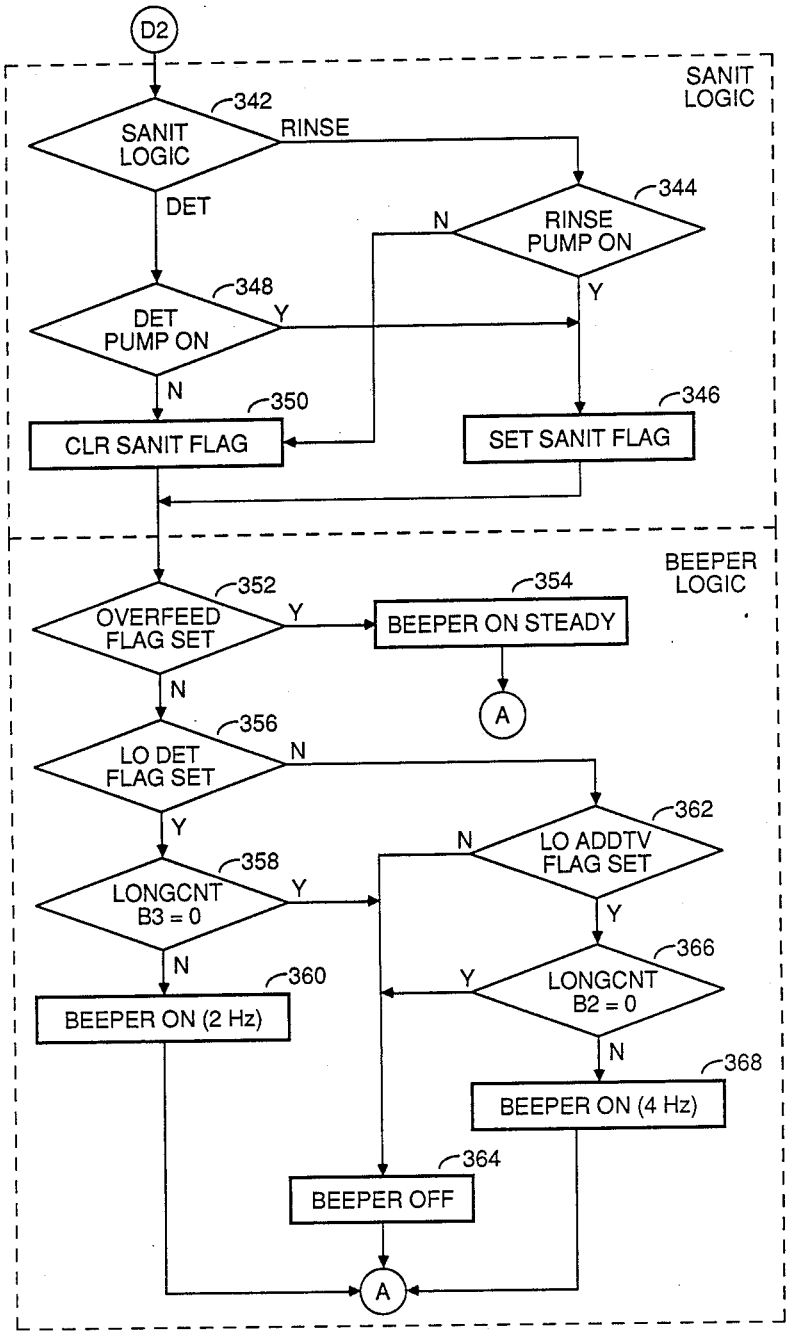
*FIGURE 14B DECISIONS*

INDUSTRIAL DISHWASHER CHEMICAL DISPENSER

The present invention relates generally to a chemical dispenser for industrial dishwasher, and particularly to an improved detergent dispenser and rinse agent dispenser control mechanical and method.

BACKGROUND OF THE INVENTION

The prior art includes a number of chemical dispensers for industrial dishwashers, including those disclosed in U.S. Pat. Nos. 4,509,543 (Livingston et al., 1985); 2,850,760 (Borell, 1955); 3,896,827 (Robinson, 1975); 4,142,539 (Shih et al., 1979); and 4,245,309 (Keifer, 1981).

The present invention addresses three shortcomings of the aforementioned prior art: the need for a better mechanism to set and control the concentration of detergent used in the wash water; the need for a better mechanism for detecting the failure of the system to add detergent to the wash water; and the waste of rinse agent and detergent in batch type industrial dishwashers.

A number of the prior art industrial dishwashers known to the inventors include a detergent level setting mechanism for setting the concentration of detergent to be maintained by the dishwasher in the wash water. In order dishwashers this level was generally either fixed or the amount of detergent used was determined by any one of a number of procedures that did not involve comparing the actual detergent concentration with a target concentration value.

In those prior art dishwashers known to the inventors which include a detergent concentration level setting mechanism, these mechanisms are "linear" in that the level specified by the user is linearly related to either the conductivity or resistivity of the wash water when the desired concentration of detergent is in the water.

These prior art detergent dispenser control mechanisms have always been somewhat unsatisfactory due to the lack of a natural or "user friendly" scaling or calibration scheme for the controller. That is, although dish water conductivity is approximately proportional to detergent concentration, the prior art detergent target level control mechanisms could not be scaled or calibrated in terms of a convenient unit such as tablespoons of detergent per gallon of wash water. Thus the numeric units, if any, on the detergent level controller tended to be arbitrary and are different on each brand of controller. As a result, the setting of the detergent level controller has generally been a trial and error procedure where the user selects a level and then adjusts the control dial up and down until an acceptable detergent level is observed. Typically the user overadjusts the control dial at least once during this procedure because of the lack of a suitable calibration scale.

During the last decade or so there prior art detergent level control mechanisms have become even less satisfactory due to two developments: the use of detergents with lower alkalinity levels and the trend toward using lower concentration levels of detergent. As a result of these developments a much broader range of detergents is being used by various dishwasher owners and the corresponding range of target conductivity or resistivity has also expanded. In particular, different users need accurate concentration control in different conductivity ranges.

The present invention solves the problem of providing a detergent level control mechanism which is accurate over a wide range of concentration levels and which provides a user friendly calibration or scaling mechanism. The problem is solved by providing a detergent level control mechanism which is scaled in logarithmic units. In particular, each unit measurement on the detergent level control corresponds to a preselected percentage change in detergent concentration. For instance, in the preferred embodiment each increment in the target detergent concentration level corresponds to approximately a five percent increase in the target conductivity of the wash water, which corresponds approximately to a five percent increase in detergent concentration.

The second problem referred to above is the inadequacy of prior art detergent dispenser control mechanisms which detect the failure of the dispenser to add detergent (which is usually caused by exhaustion of the detergent supply, but can also be caused by disconnection of the detergent supply hose and other such problems) by detecting the failure of the detergent to reach the target level within a specified amount of time. In some prior art devices the length of the time period used for this purpose can be selected by the user through the use of a calibrated dial. Typically the period of time used is at least two minutes long.

This detergent feeding failure detection mechanism is unsatisfactory for at least two reasons. First, if the failure is caused by a disconnection of the detergent feeding hose, a large quantity of detergent may be wasted before the control mechanism stops the detergent pump and issues a warning. Second, in batch type dishwashers the wash cycle is often only 45 seconds or so long and thus is too short for these type of mechanisms to detect a detergent feeding failure.

The present invention solves the above described problem by providing a mechanism which is sensitive to changes in the concentration of detergent in the wash water and which detects the failure of that concentration level to change. In the preferred embodiment, if the detergent concentration level does not increase by at least a certain predefined amount during a twelve second period in which the detergent dispenser is turned on, a detergent feeding failure alarm is generated.

The third problem addressed by the present invention is that the prior art dishwasher controllers known to the inventors do not distinguish between batch and conveyor type dishwashers. As a result, these prior art dishwasher controllers (1) allow rinse agent to be added to the rinse water through the full rinse cycle; and (2) allow detergent to be added to the wash during the rinse cycle.

Rinse agent facilitates the sheeting of water from dishes and thereby decreases spotting. In general, rinse agent can be saved without significant loss of sheeting action by using rinse agent only during the end of the rinse cycle.

Detergent should not be added to the wash water in batch type dishwashers during the rinse cycle because the lack of dish water agitation during the rinse cycle often results in the use of excessive amounts of detergent. More specifically, the wash water pump does not operate during the rinse cycle in batch type dishwashers. As a result, newly added detergent mixes poorly with the wash water during the rinse cycle. Therefore the measured detergent concentration will not reflect the amount of detergent actually in the wash tank and more detergent may be added to the wash tank than is needed to achieve the target concentration level.

In conveyor type dishwashers the continuous feeding of rinse agent is reasonable since new racks of dishes keep passing through the rinse section of the machine and therefore it is difficult to identify the end of the rinse cycle for each rack of dishes. In batch type dishwashers, however, the timing of the rinse cycle for each rack of dishes is known since only one set of dishes is being washed at a time. Similarly, in conveyor type dishwashers it is reasonable to enable the adding of detergent to the wash tank whenever the dishwasher is on because the wash water pump will always be on, thereby ensuring proper mixing of the detergent as it is added to the wash tank.

The present invention solves the above discussed problem by providing a switch for identifying the type of dishwasher attached to the rinse agent dispenser, a timer control mechanism for controlling the portion of the rinse cycle in which rinse agent is used, and a control strategy which prevents the addition of detergent to the wash water during rinse cycles in batch type dishwashers.

These and other features and advantages of the present invention are discussed more fully in the detailed description of the preferred embodiment.

It is therefore a primary object of the present invention to provide an improved industrial dishwasher chemical dispenser controller.

While the present invention concerns a dishwasher chemical dispenser and its controller, for convenience the term "dishwasher controller" is used herein synonymously with the term "dishwasher chemical dispenser controller". Therefore the term "dishwasher controller" is not used herein to mean a dishwasher sequence controller (such as item 46 in FIG. 1), except to the extent that a single, integrated control system provides both dishwasher sequence and chemical dispensing control features.

Another object of the present invention is to provide a dishwasher controller which includes a logarithmically scaled detergent level control mechanism.

Yet another object of the present invention is to provide a dishwasher controller which detects a detergent feeding failure by monitoring changes in the concentration of detergent in the dishwasher's wash water.

Still another object of the present invention is to provide a dishwasher controller with means for limiting the use of rinse agent to a preselected portion of the rinse cycle.

SUMMARY OF THE INVENTION

In summary, the present invention is a chemical dispenser and controller for industrial dishwashers. The level of detergent concentration in the dishwasher wash water is measured in logarithmically scaled unit, and the target detergent concentration level is specified in similar units. The dishwasher's controller converts wash water conductivity measurements into logarithmically scaled detergent concentration measurements. The controller also monitors the detergent concentration level and generates an alarm if the measured detergent concentration fails to increase by at least a predefined amount while the detergent feeding mechanism is turned on. The controller also generates an alarm if the measured detergent concentration fails to reach its target level after the detergent feeding mechanism has been on for a predetermined time period. Further, the controller includes different control strategies for conveyor and batch type dishwashers, including a control method for conserving rinse agent and detergent in batch type dishwashers.

BRIEF DESCRIPTION OF THE DRAWINGS

Additional objects and features of the invention will be more readily apparent from the following detailed description and appended claims when taken in conjunction with the drawings, in which:

FIG. 2A is a related timing diagram.

FIG. 3 depicts an overview flowchart of the method of the invention.

FIG. 4 is a flowchart of the main computer software routine which controls the operation of the dishwasher controller.

FIG. 5 is a flowchart of the timer interrupt routine.

FIGS. 12, and 12A–12D are a flowchart of the BETAUNIT routine which includes the BETACALC routine, which computes the detergent concentration in the wash water, and the SLOPEA, SLOPEB, and HOWFAR routines which check for a low detergent fault by performing a linear regression on the most recent detergent concentration measurements to see if the rate of increase in the detergent concentration is sufficient to indicate that detergent is being properly added to the wash water.

FIG. 13 is a flowchart of the TIMESTUFF routine which performs several time dependent control functions.

FIGS. 14A and 14B depict a flowchart of the DECISIONS routine which determines when to turn on/off the detergent pump, the sanitizer pump and the beeper.

DESCRIPTION OF THE PREFERRED EMBODIMENT

Figure 1:
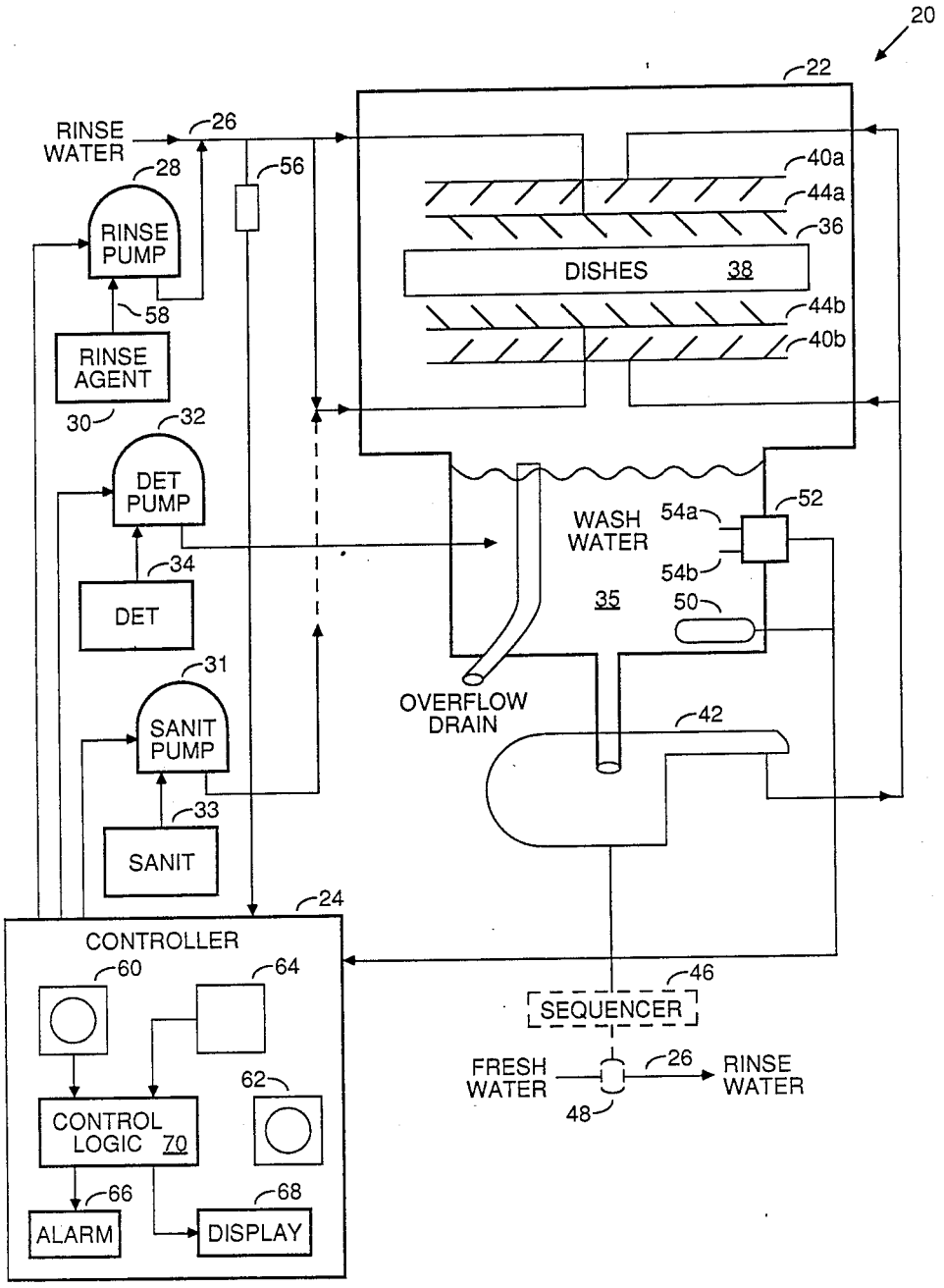
FIG. 1 is a block diagram of an industrial dishwasher system incorporating the present invention.

Referring to FIG. 1, there is shown an industrial dishwasher system 20 incorporating the present invention. The dishwasher system 20 includes a dishwashing unit 22, a plumbing system, and a chemical dispenser controller 24.

With respect to the standard mechanical aspects of any such dishwashing system 20, the primary elements of the plumbing system include a rinse water line 26 for conveying fresh water into the dishwashing unit 22, and a rinse pump 28 for adding rinse agent from a rinse agent supply 30 into the rinse line 26. Similarly, a detergent pump 32 is used to add detergent from a detergent supply 34 into the dishwasher's wash water tank 35.

The dishwashing system 20 can include a sensitizer pump 31 to add sanitizer from a sanitizer supply 33 to either the rinse water or wash water. Sanitizer, which is usually bleach or a similar antibacterial chemical, is typically used only in "low temperature" dishwashers with rinse water temperature below 160 degrees Fahrenheit.

The dishwasher 22 can be any one of several commercially sold industrial dishwashers. Therefore, the dishwasher 22 can be either of the batch type or the conveyorized type. In either type of dishwasher 22 the dishes are first subjected to a flow of wash water for a period typically ranging between forty-five seconds and one minute thirty seconds, and are then subjected to rinse water for a period typically ranging between ten seconds and thirty seconds. In a batch type of dishwasher 22 one or more trays 36 of dishes 38 are placed inside the dishwasher and then subjected to a wash cycle and then a rinse cycle and then are removed before the next set of dish trays 36 is washed. In a conveyorized dishwasher 22 trays of dishes travel on a conveyor through two sections: a wash section and then a rinse section.

The water used in the wash cycle is generally recycled water held in a water tank 35 below the trays 36 of dishes 38. Thus the dishes being cleaned are initially sprayed, using sprayer arms **40*a* and 40*b* above and below the dishes, with water from the wash water tank 35 that has been used before. The wash water contains a predetermined amount of detergent for sanitizing the dishes. A wash water pump 42 is used to draw wash water from the wash water tank 35 and pump it into the sprayer arms 40*a* and 40*b*. The action of the wash water pump 42 agitates the water in the wash water tank 35, thereby promoting proper mixing of the detergent in the wash water tank 35**.

The water used to rinse the dishes is clean, hot water sprayed on the dishes using sprayer arms **44*a* and 44*b*. The wash water sprayer arms 40*a* and 40*b* and the rinse water sprayer arms 44*a* and 44*b*** have completely separate plumbing.

Batch type dishwashers 22 generally include a sequencer 46 which controls when the wash water pump 42 is on (i.e., during the machine's wash cycle), and when the rinse water control solenoid 48 allows clean water to flow into the rinse water line 26 (i.e., during the rinse cycle). Therefore these basic timing functions are provided by the dishwasher's built in sequencer 46 rather than the controller 24 described below. In conveyorized dishwashers, the wash water pump 42 is always on when the dishwasher is active, but the rinse water solenoid 48 is activated only when a sensor arm in the rinse section of the dishwasher detects the presence of a rack of dishes.

There are a number of additional mechanical and electromechanical aspects of industrial dishwashers (such as the rinse water and wash water heaters, and the drying agent pump) which are well known to those skilled in the art but which are not described herein because they are not necessary for an understanding of the basic operation of dishwashers and are not aspects of the present invention. For an explanation of some of these aspects of dishwashers see the patents cited above, including U.S. Pat. No. 4,509,543 which is hereby incorporated in its entirety by reference.

The controller 24 is designed for use with both batch and conveyor types of dishwashers. It is connected to the other parts of the dishwasher system 20 as follows. First, it is connected to thermistor 50 in the wash tank 35 for determining the temperature of the wash water. It is also connected to probe 52, which includes two electrodes **54*a* and 54*b*** which are held a predetermined distance from one another and which are used to determine the resistivity or conductivity of the wash water. This resistivity or conductivity measurement is used to determine the amount of detergent in the water.

The controller 24 is also connected to a pressure switch 56 which detects increases in pressure in the rinse water line 26, thereby enabling the controller 24 to determine when water is flowing through the rinse line 26. A vacuum switch (not shown in the Figures) on the rinse agent feed line 58 is used to detect when the rinse agent supply has run out.

The controller 24 has a multiplicity of digital and analog parameter input switches 60–64. An alarm (also called a beeper) 66 is provided for warning the dishwasher operator when an apparent malfunction has been detected. A display 68 includes a number of warning lights for specific alarm conditions (such as depletion of the rinse agent supply) and a standard two digit, seven segment LED (light emitting diode) display for digital values such as the measured wash water detergent concentration level.

Figure 2:
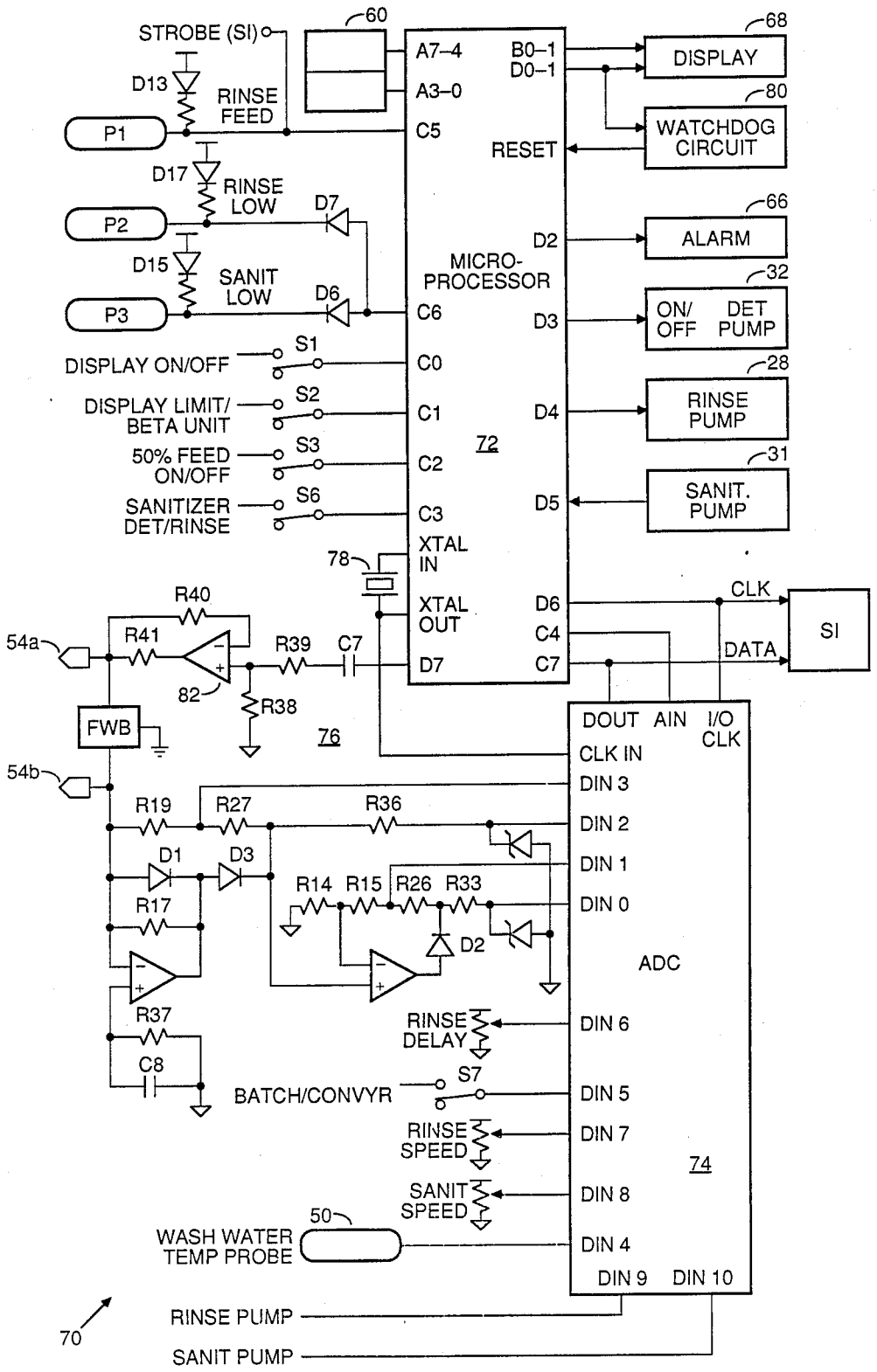
FIG. 2 depicts the control circuitry of a dishwasher controller in accordance with the preferred embodiment of the present invention.

The controller's control logic 70 includes the circuitry shown in FIG. 2 and the software used by the system's microprocessor 72 to control the operation of the system 20.

Control Circuitry

Referring to FIG. 2, the circuitry of the controller's control logic 70 is built around a microprocessor 72, which in the preferred embodiment is a TMS 7020 made by Texas Instruments. The other main components of the controller 24 are an analog to digital converter (ADC) 74, which in the preferred embodiment is a TLC 541IN made by Texas Instruments, and a conductivity measurement circuit 76.

The controller 24 accepts the following input control signals. The target detergent concentration level is determined by a two decimal digit signal from binary-coded decimal switches 60. Both the detergent concentration and its target level are measured in "Beta" units, a logarithmically scaled concentration measurement scale which is a part of the present invention. Each unitary increase of the wash water conductivity level measured in Beta units corresponds to approximately a 5 percent increase in the detergent concentration level (e.g., as measured in units of detergent per gallon of wash water).

A rinse enable sensor P1 (which can be either a pressure switch 56 as shown in FIG. 1, or simply an electrical contact to the control line for the rinse water solenoid 48), connected to microprocessor port C5, detects when rinse water is flowing into the dishwasher 22. Rinse Low and Sanitizer Low sensors P2 and P3 are both vacuum switches coupled to the inlet sides of the corresponding pumps 28 and 31. The sensors P2 and P3, which are connected to microprocessor port C6 through separate diodes D6 and D6, detect the absence of rinse agent and sanitizer in the feed lines into the corresponding pumps 28 and 31. The input signal to port C6 is called Additive Low.

Each of the sensors P1, P2 and P3 is coupled to an LED (D13, D17 and D15, which are labelled RINSE FEED, RINSE LOW, and SANIT LOW, respectively) which is energized when the corresponding sensor detects the flow of rinse water, the absence of rinse agent, or the absence of sanitizer, respectively.

Note that the C5 microprocessor port is also used to send a STROBE signal to a Serial Interface. As described below with reference to the DEBOUNCE and DIGITAL routines, the STROBE signal marks the beginning of a record of logging data.

A Display On/Off switch S1, connected to microprocessor port C0, determines whether or not the display 68 is turned on.

Display Limit/Beta Unit switch S2, connected to microprocessor port C1, determines whether the display is in Limit mode or Beta Unit mode. In Limit mode the display registers "Lo" if the wash water detergent level is below target, "Hi" if the wash water detergent level is above target, and "--" if the wash water detergent level is at or within a predefined range of target. In Beta Unit mode the display registers the decimal value, in Beta units, of the current wash water detergent level (unless that level is out of range, in which case the display registers "Lo" or "Hi" as appropriate).

Note that when switch S1 is "Off" and switch S2 is set to "Beta" the display 68 displays the wash water temperature in degrees Celsius.

When the 50% Feed switch S3, connected to microprocessor port C2, is on it causes the controller 24 to operate the detergent pump 32 on a fifty percent duty cycle when the wash water detergent level is within three Beta units of the target level. The purpose of this feature is to prevent the system from overshooting the detergent target level. Detergent does not instantaneously dissolve and spread evenly throughout the wash tank. Therefore in systems which have a relatively fast detergent feeding mechanism overshoot is a common problem. In systems with slow detergent feeding mechanisms overshoot is not a significant problem and the 50% Feed feature should not be selected.

The Sanitizer Det/Rinse switch S6, connected to microprocessor port C3, must be set by the system's user to indicate whether sanitizer is added to the wash ater or to the rinse water in the particular system that the controller 24 is connected to.

A 2.000 megahertz crystal, connected to the microprocessor 72, provides a time base for the whole system. The microprocessor 72 includes an internal timer mechanism, responsive to the crystal time base signal, which causes an interrupt to occur at time intervals defined by a user specified parameter. In the preferred embodiment, this interrupt occurs approximately once every 0.5 milliseconds (actually once every 0.4883 milliseconds). This initiates running of the Timer Interrupt routine, described below with reference to FIG. 4, by the microprocessor 72.

Watchdog circuit 80 monitors one of the display control lines, which should normally experience a 50% duty cycle signal with activity no less than once every four milliseconds. The Watchdog circuit 80 resets the microprocessor 72 if the duty cycle of the display control line over a period of approximately 50 milliseconds is significantly different from 50%.

Conductivity measurement circuit 76 works as follows. A one kilohertz square wave is generated by the microprocessor 72 on port D7, which is a.c. coupled to probe **54*a* through an RC filter C7-R39-R38 and amplifier 82 (with feedback resistors R40 and R41**).

The occurrence of a sudden voltage change on the first probe **54*a* causes current to flow between the first and second probes 54*a* and 54*b*. The resulting signal on the second probe 54*b*** is proportional to the conductance of the wash water, which is proportional to the amount of detergent dissolved in the wash water.

In order to minimize the effect of the wash water capacitance on the conductivity measurement, the signal on the second probe **54*b* is measured as soon as possible after the voltage change (from a high voltage to a low voltage) on the first probe 54*a*. With the microprocessor used in the preferred embodiment, the second probe signal is measured (i.e., sampled and held by ADC 74**) approximately 10 microseconds after the D7 square wave signal is toggled from a high to a low state.

Referring briefly to the timing diagram in FIG. 2A, the ADC 74 samples and holds the selected probe measurement on the falling edge of the eight clock cycle of the ADC's I/O clock. The timing of the ADC's I/O clock is controlled by the Timer Interrupt routine, as described below with reference to FIG. 5.

Referring again to FIG. 2, the measurement circuit 76 divides the measurement into four conductivity ranges because (1) an 8-bit ADC is used, and (2) range of conductivity levels which need to be measured requires more than eight bits of accuracy. Four distinct signals are generated and are read by the microprocessor through the Din3 through Din0 ports of the ADC 74. Each of the four conductivity signals is proportional to the wash water conductivity when the conductivity is in a corresponding range.

In an alternate embodiment of the invention, a 12-bit ADC could be used, which would increase the cost of the system. In this embodiment a single conductivity measurement could take the place of the four used in the preferred embodiment and, as will be understood by those skilled in the art, the corresponding circuit 76 would be considerably simplified.

Both probes **54*a* and 54*b* are coupled to a full wave bridge rectifier solely for the purpose of using the diodes therein to clamp both probes to a voltage not greater than approximately 0.5 volts higher than the system's ground voltage. This protects circuit 76** from transient and/or extraneous voltages.

The Din3 signal is used for measuring the highest range of conductivity values, the Din2 signal is used for measuring the next lower range of conductivity values, and so on. Each step down to a lower range of conductivity signals increases the measurement's sensitivity to the wash water conductance by a factor of approximately 2.72 (i.e., $e^1$). Thus if a value of ten was measured on Din3 to the ADC, the corresponding values would be approximately 27.2 on Din2, 73.0 on Din1 and 201.2 on Din0.

Since relatively low value measurements are subject to more noise than those in the middle of their dynamic range, the preferred method of the invention is to select the lowest sensitivity conductivity signal which has a value above the noise level. The dynamic range of the ADC is eight bits, or zero to 255. In the preferred embodiment, the Din3 through Din1 signals are not used unless their value exceeds 70, and even the Din0 signal is rejected as noise unless its value exceeds 31.

Other input signals to the ADC 74 are: (Din4) the wash water temperature probe signal; (Din5) a binary Batch/Conveyor signal produced by switch S7 which indicates whether the dishwater 22 is a conveyor type or a batch type; (Din6) an analog Rinse Delay signal which is used to determine the length of time that rinse agent is not added to the rinse water at the beginning of each rinse cycle; (Din7) an analog Rinse Speed signal, produced by a pot resistor, which is used to control the speed of the rinse pump 28; (Din8) an analog Sanitizer Speed signal which is used to control the speed of the sanitizer pump 31; (Din9) the back emf (electro-magnetic force) from the rinse pump; and (Din10) the back emf from the sanitizer pump.

The ADC 74 used in the preferred embodiment (a TLC 541IN made by Texas Instruments) communicates with the microprocessor 72 using bit serial data and address transfers. Eight I/O clock cycles are needed to transfer an eight bit value from the Dout port of the ADC 74 to the C7 port of the microprocessor 72. During the first four clock cycles the address of the ADC port which is to be read next is transferred from port C4 of the microprocessor 72 to the Ain port of the ADC 74. The data from the ADC 74 is also transmitted to serial interface SI, from which it can be recorded or analyzed by equipment external to the dishwater controller 70. Referring to FIG. 2A, the ADC samples and holds the selected input port on the falling edge of the eighth I/O clock cycle.

Port C7 is also used to transmit logging data regarding the status of the system to a Serial Interface (SI) node labeled "Data". Approximately thirty-two times per second data regarding the detergent concentration in the wash tank 35, the wash water temperature, the target concentration level, and the system's internal status flags is sent to the Data line of the Serial Interface. An appropriate recording device or computer can be connected to the Serial Interface for recording and analyzing the data transmitted.

Software Overview

Figure 15:
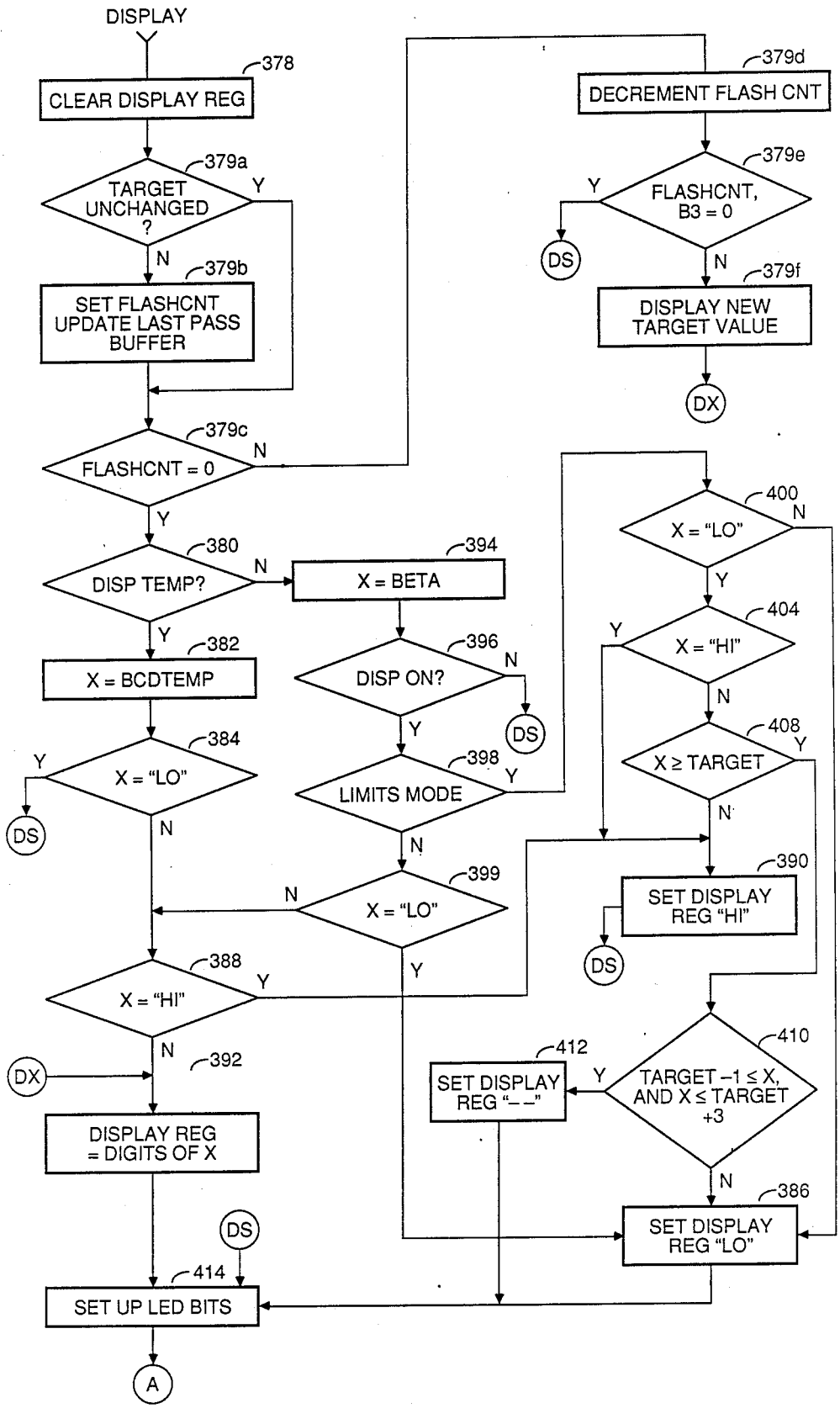
FIG. 15 is a flowchart of the DISPLAY routine which computes the contents of the registers which control the system's display.
Figure 16:
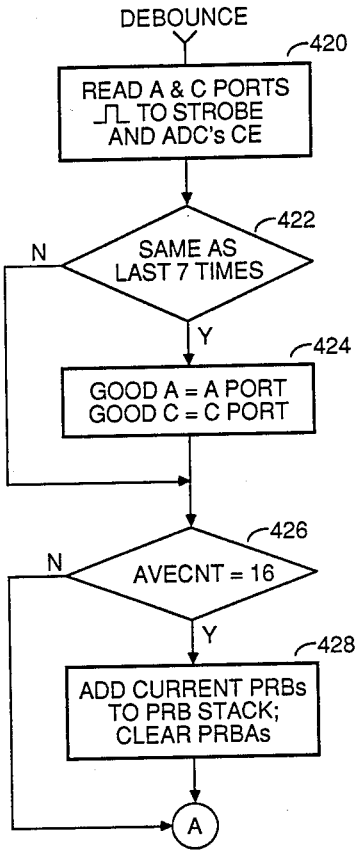
FIG. 16 is a flowchart of the DEBOUNCE routine which buffers the system from fluctuations in the signals which communicate user parameter selections.

FIG. 3 depicts the controller's general control process which is repeated 32 times per second. FIGS. 4 and 5, discussed below, show how the basic timing aspects of the control process work. FIGS. 6 through 11 show how the system reads in physical measurements, such as detergent conductivity and wash water temperature, and controls the speed of the rinse and sanitizer pumps. FIGS. 12 through 14 show most of the basic decision making aspects of the control method. FIG. 15 shows how the system's display is controlled. FIG. 16 shows how the system's digital and binary user option signals are debounced.

The actual execution order of the control routines is shown in Table 1.

One control cycle is defined herein as one pass through the full control loop shown in FIG. 3. In the preferred embodiment this takes approximately 32 milliseconds.

Referring to FIG. 3, the control sequence begins (at box 101) by reading the detergent concentration probe signal to measure the wash water conductivity. As will be explained in more detail below, the value obtained is averaged over sixteen control cycles.

The next step is to adjust the rinse and sanitizer pump speeds (box 102) in accordance with preselected target speed values. Then the rinse speed, sanitizer speed, rinse delay, batch/conveyor and wash water temperature inputs to the ADC 74 are read (box 103).

At the beginnings of the second half of the control sequence the detergent concentration probe signal is read a second time (box 104). Therefore thirty-two probe signal samples are used per control sequence.

If sixteen control cycles have accumulated since the last time the BETAUNIT routine was run, then the Beta value of the detergent concentration in the wash water is computed by the BETAUNIT routine using the previously accumulated probe values (box 105). In one preferred embodiment, during other control cycles the process checks for a low detergent fault by performing a linear regression on the most recent detergent concentration measurements to see if the rate of increase in the detergent concentration is sufficient to indicate that detergent is being properly added to the wash water.

The next step is to read in the binary inputs to the microprocessor (box 106) including the Rinse Enable, Low Additive, Display on/off, Display Limits/Beta, 50% feed, Sanitizer Logic, and Detergent target value signals.

Then the DECISIONS routine determines whether to turn on or off the detergent pump, sanitizer pump and beeper (box 107). This is followed by the transmission of data on the status of the system to a serial interface for logging (box 109).

The last step of the control process cycle is the TIMESTUFF routine (box 110) which performs a number of time dependent control functions including setting up the rinse delay at the beginning of rinse cycles, checking detergent overfeed faults, and setting up the 50% detergent feed duty cycle used to prevent detergent overfeed when the detergent concentration level is close to its target level.

In an alternate embodiment of the invention, which uses a simplified test for finding low detergent faults, the low detergent test is performed by the TIMESTUFF routine rather by a set of linear regression routines which run during the same time slot as the BETAUNIT.

Timing Control

Referring to FIG. 4, the EXEC LOOP routine controls the order in which the system's control routines are run, and the TIMER INTERRUPT routine shown in FIG. 5 controls the rate at which the control process proceeds.

When the controller 24 is first turned on or reset a number of initialization functions must be performed (box 115) including initializing the microprocessor's ports; clearing the microprocessor's internal random access memory; setting up certain initial parameter values such as loop control parameters AVECNT and CNT; setting up certain other software controlled timers; turning off the detergent, rinse and sanitizer pumps; and enabling the microprocessor's interrupts (so as to enable the timer interrupt mechanism described below with reference to FIG. 5).

The EXEC LOOP routine's timing mechanism comprises an idling loop (boxes 116 and 117) which marks time until the CNT control variable is found to have a even value (e.g., 62 or 60). At such time, the two digit 7-segment portion of the display 68 is updated (box 118) by transmitting the contents of the internal display registers to the display hardware through microprocessor port B. In the preferred embodiment alternating ones of the two display digits are updated during every fourth such control cycle.

Then one of the control routines is called (box 119). The particular one called is selected in accordance with the current value of CNT/2, as shown in Table 1. Note that the value CNT is decremented once every 0.5 milliseconds. After the control routine is finished the controller idles (boxes 116 and 117) until CNT is decremented to a new even value.

Referring to FIG. 5, once every 0.5 milliseconds a hardware timer interrupt is generated by clock 78 which initiates the running of the TIMER INTERRUPT routine. The routine begins by toggling the concentration probe phase on microprocessor port D7 (box 121). This generates a 1 kilohertz square wave on port D7.

Referring temporarily to FIG. 2A, if the D7 signal is being pulled low, the ADC's I/O clock is pulled low so as to cause the ADC to sample and hold the input to ADC's currently selected input port.

Next (boxes 122 through 125) the pulse width modulation (PWM) parameter for the rinse pump, which controls the length of the drive current pulse for the rinse pump, is tested and decremented. If the rinse PWM value is zero either before or after being decremented, the rinse pump is turned off (box 125). Similarly (boxes 130 through 136), the Sanitizer PWM is tested and decremented and the sanitizer pump is turned off if the Sanitizer PWM value is zero.

Then the loop counter CNT is decremented (box 138) and if the resulting value is zero (box 140) the control cycle is restarted from the beginning (box 142) by setting CNT to 64 and by fixing the phases of the probe and display digit signals.

When the TIMER INTERRUPT routine exits it returns to whatever routine was previously running. Since most of the controller routines require less than 0.5 milliseconds to execute, in most instances the controller will be idling (box 116) in the EXEC LOOP (FIG. 4) when the timer interrupt occurs. However, several routines (including the BETAUNIT, RINSESPEED and SANITSPEED, and the detergent alarm routines of the preferred embodiment) can in some instances take over 1.0 milliseconds to execute. In such cases, when the TIMER INTERRUPT routine exits, the controller will resume execution of the previously running routine at the point at which it was interrupted.

Referring to Table 1, the "NULL" entries after RINSESPEED, SANITSPEED and BETAUNIT routines allow time for these routines to run more than 1.0 milliseconds. Each NULL entry provides 1.0 milliseconds additional run time. Note that these NULL routine entries aren't called (see box 119) unless the previously called routine has completed its task. Thus in instances where one of these long routines uses the full time slot allocated to it, the CNT variable will be decremented several times by the Timer Interrupt routine before it is tested again by the EXEC LOOP routine.

ADC Control and Use

See the above discussion of FIG. 2 for an explanation as to how data is transmitted from the ADC 74 to the microprocessor 72 and how the microprocessor 72 controls which of the ADC's input ports is read.

Figure 6:
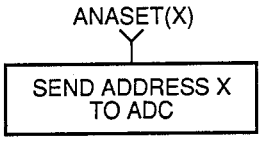
FIG. 6 is a flowchart of the ANASET routine for setting up the ADC.

Referring to FIG. 6, the ANASET (X) routine merely sends a preselected four binary digit address value X to the ADC 74, which determines which input to the ADC will be read next by the microprocessor 72. Thus the use of ANASET (3) at the beginning of each control cycle (see Table 1) sets up the ADC 74 for reading the Din3 wash water conductivity signal into the microprocessor 72 during the next step of the control cycle.

Referring to FIG. 2A, it should be noted that the ANASET, PROBE, and POT routines (as well as the other routines which read data from the ADC 74) all generate eight I/O clock cycles for the ADC, leaving the ADC's I/O clock line high at the end of the eighth clock cycle. The eighth clock cycle is completed by the Timer Interrupt routine (see box 121 of FIG. 5).

Figure 7:
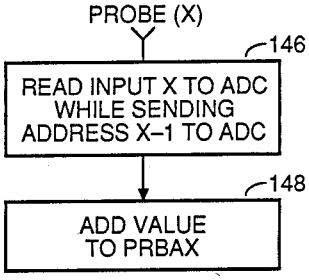
FIG. 7 is a flowchart of the PROBE routine for measuring the wash water conductivity.

Referring to FIG. 7, the PROBE (X) routine reads input DinX to the ADC 74 while sending address X-1 to the ADC (box 146). Thus each execution of the PROBE (X) routine prepares the ADC for the next use of the PROBE (X) routine. Each of the four probe values read in is averaged over 16 control cycles, and thus each time a probe value is read it is added to the corresponding probe value accumulator PRBAX (box 148).

Figure 8:
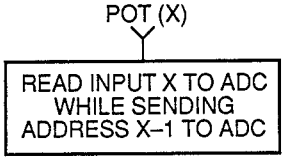
FIG. 8 is a flowchart of the POT routine for reading the analog signal inputs to the ADC.

Referring to FIG. 8, the POT (X) routine is used for reading in the sanitizer speed, rinse speed, rinse delay and batch/conveyor input signals to the ADC 74. In each instance while one parameter is read into the microprocessor 72, the ADC 74 is sent the address for the next parameter to be read by the microprocessor 72.

Figure 9:
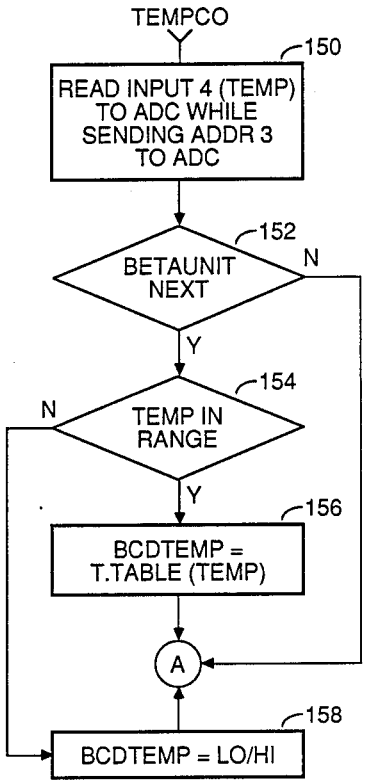
FIG. 9 is a flowchart of the TEMPCO routine for reading the wash water temperature measurement signal.

Referring to FIG. 9, after the four POT values are read through the ADC 74, the TEMPCO routine is used to read in the wash water temperature signal on the Din4 port of the ADC 74 (box 150). Note that the previously run routine, BATCH/CONV, also called POT (5), set up the ADC 74 to read the Din4 port on the next ADC read cycle. Also, the TEMPCO routine sets up the ADC to read the Din3 port on the following ADC cycle (during the following PROBE (3) routine).

Note that the temperature value read by the ADC 74 is a voltage produced by a resistive voltage divider consisting of a fixed resistor and a thermistor (i.e., a temperature dependent resistor). The resistance of the thermistor is not exactly linearly related to temperature. Therefore the voltage read by the ADC 74 is converted into a temperature using a lookup table which accounts for the nonlinearities of the thermistor. The values in this table were developed by the inventors simply by measuring the voltage value produced for each temperature value in the table.

If the BETAUNIT routine is to be run during next control cycle (box 152) (i.e., if AVECNT=2), then the temperature value is tested to see if it is in range (between 0 and 99 degrees Celsius) (box 154). If so, the display temperature parameter BCDTEMP is obtained by using a lookup table to convert the temperature sensor value into a binary coded decimal Celsius temperature value (box 156); otherwise the BCDTEMP parameter is filled with a special flag value to indicate whether the measured temperature was too high or too low (box 158). Then the routine exits back to entry point A of the EXEC LOOP and the controller idles.

Rinse and Sanitizer Pump Speed Control

Figure 10:
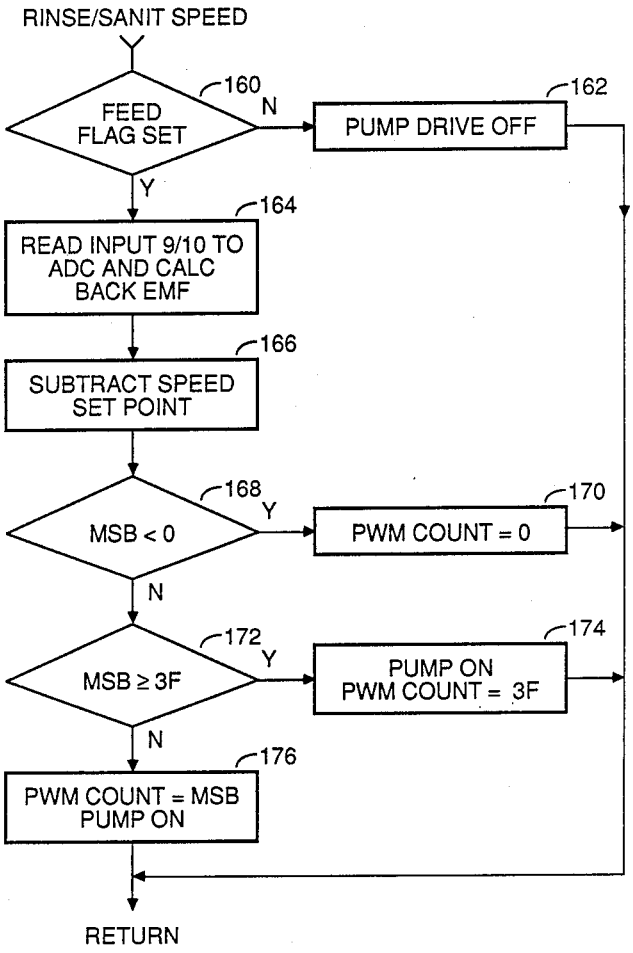
FIG. 10 is a flowchart of the RINSE/SANITIZER SPEED routine for controlling the speed of the rinse and sanitizer pumps.

Referring to FIG. 10, the rinse and sanitizer pump speeds are adjusted in accordance with preselected target speed values. Both of these pumps are simple d.c. motors. The speed of these pumps is controlled by measuring the back emf of both pumps, comparing the measured value with a preselected target speed value, and then adjusting the width of the pump's drive pulse accordingly. The widths of the rinse and sanitizer drive pulses are controlled by parameters called the rinse and sanitizer PWM counters.

Note that the Detergent pump 32, unlike the rinse and sanitizer pumps, is a single speed pump which is controlled by a binary on/off signal on the D3 port of the microprocessor 72.

FIG. 10 depicts two separate routines, RINSE SPEED and SANIT SPEED, which are identical except for the source of the input of the speed target value and the output port used to drive the corresponding pump. For convenience, only the RINSE SPEED routine will be described here.

First the Rinse feed flag is checked (box 160) to see if the rinse pump is supposed to be turned on or off. If the flag is not set, the rinse pump drive is turned off (box 162) and the routine exits. Otherwise the rinse pump back emf is read from the Din9 port of the ADC 74 and multiplied by a predetermined gain factor (box 164). Then the rinse speed target value (which equals the rinse speed parameter read in by the RINSESPOT routine, multiplied by a predetermined offset value) is subtracted from the scaled emf value (box 166). The most significant byte (MSB) of the resulting two byte value is then tested.

If the MSB is less than zero (box 168), then the rinse pump is already going at a speed equal to or greater than the rinse speed target value and the rinse PWM counter is set to zero (box 170) so that the rinse pump is allowed to slow down. If the MSB is greater than $3F_{16}$ (equal to 63 in base 10) (box 172) then the rinse motor is going too slow and the rinse PWM is set to its maximum allowable value, 3F, and the rinse pump drive signal is turned on (box 174). If the MSB is between 0 and $3F_{16}$, then the rinse PWM counter is set equal to the MSB and the rinse pump drive signal is turned on (box 176).

Data Logging

Figure 11:
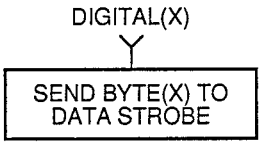
FIG. 11 is a flowchart of the DIGITAL routine for sending data to a serial interface for logging.

Referring to FIG. 11 and Table 1, towards the end of each control cycle four bytes of data are transmitted to the Data terminal of a Serial Interface from which they can be recorded and analyzed. One byte of data is transmitted during each routine call. The data transmitted is (1) the detergent concentration (BETA) measured in Beta units, (2) the wash water temperature (BCDTEMP), (3) the detergent concentration target value as determined by the system's user using switches 60, and (4) the system's internal flag register which indicates: which pumps are turned on, the presence or absence of Low Additive, Low Detergent and Detergent Overfeed faults, whether the beeper is turned on, and whether the 50% detergency duty cycle is currently enabled.

Note that the STROBE port of the Serial Interface (SI) is pulsed by the DEBOUNCE routine before the above mentioned data is transmitted so as to mark the beginning of each new data record.

Logarithmic Scaling of Detergent Concentration Measurement

As discussed above, the present invention solves the problem of providing a detergent level control mechanism which is accurate over a wide range of concentration levels and which provides a user friendly calibration or scaling mechanism. The problem is solved by providing a detergent level control mechanism which is scaled in logarithmic units. In particular, each unit measurement on the detergent level control corresponds to a preselected percentage change in detergent concentration. For instance, in the preferred embodiment each increment in the target detergent concentration level corresponds to approximately a five percent increase in the target conductivity of the wash water, which corresponds approximately to a five percent increase in detergent concentration.

Figure 12A:
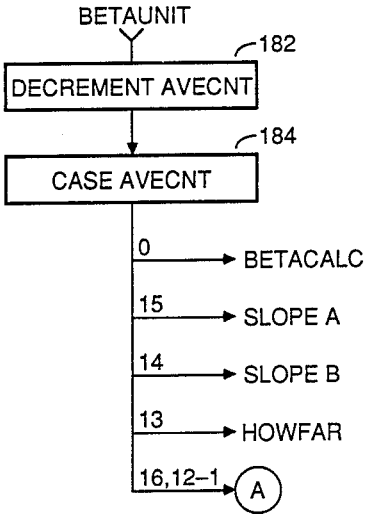

Referring to FIG. 12A, the BETAUNIT routine allocates use of the corresponding three millisecond time slot to the BETACALC, SLOPEA, SLOPEB and HOWFAR routines. Each is executed only once every sixteen control cycles. The AVECNT counter is used to count control cycles. Thus at the beginning of the BETAUNIT routine the AVECNT counter is decremented (box 182) and tested (box 184).

If AVECNT=0, the BETACALC routine calculates the Beta unit detergent concentration level from the probe measurement data previously collected. If AVECNT=15, 14 or 13 the SLOPEA, SLOPEB, and HOWFAR routines are run. These routines check for a low detergent fault by performing a linear regression on the most recent detergent concentration measurements to see if the rate of increase in the detergent concentration is sufficient to indicate that detergent is being properly added to the wash water.

Referring to FIG. 12, which depicts the flowchart of the BETACALC routine, initial computations (box 186) require that the previously computed Beta value be stored for later use in Oldbeta. AVECNT is reset to sixteen, and the thirty-two sets of probe measurement values obtained by the PROBE (X) routines during the previous sixteen control cycles, which are accumulated in four variables labelled PRBA3, PRBA2, PRBA1 and PRBA0, are averaged. In the preferred embodiment, probe measurements are averaged simply by adding all the measurements as they are obtained, with a separate accumulator being used for each of the four measurement ranges, and then dividing by 32. The resulting averaged values are stored in variables labeled PRB3, PRB2, PRB1, and PRB0.

Generally, the probe measurement data is converted into a Beta unit value as follows. First an abscissa Betacc is calculated based on the measurement range PRBx selected; then a mantissa B is calculated based on the selected PRBx; a temperature compensation factor is calculated; the mantissa is rounded down if the detergent feed is to help prevent the detergent motor from chattering on and off; and the final Beta unit value (stored in the Betacc variable) is converted into BCD units for display purposes.

Note that the logarithmic Beta detergent concentration scale works as follows: each Beta unit represents about a 5% change in detergent concentration; twenty Beta units represents a change in detergent concentration of 271.8%; and each measurement range is offset from its neighbors by 20 Beta units.

The first step (boxes 188 through 206) is to convert the probe measurement value into a Beta unit value. The PRB3 value is tested to see if it equals at least 71 (box 188). If so, Betacc is set to 60, and A is assigned the value of PRB3 (box 190). If not, similar tests (boxes 192, 196 and 200) are performed on the PRB2 and PRB1 values until the best measurement range is found. Then the abscissa Betacc is assigned the corresponding value and the variable A is assigned the value of the selected measurement (boxes 194, 198 and 202). If the detergent concentration measurement in even the lowest measurement range is too low, then Betacc is simply assigned a value of PRB0−36 (box 204). Otherwise a mantissa B is calculated by finding the largest value in the LogTb1 lookup table which is less than A, and assigning the index of that value to B (box 206). The preferred embodiment of the LogTbl lookup table is shown in Table 2.

The next step, temperature compensation (boxes 208 and 210), adjusts the detergent concentration 1.8% (equal to 0.36 Beta units) per degree Celsius. Since conductivity increases with temperature, as the temperature increases the Beta detergent value is decreased to obtain an accurate detergent concentration value. In the preferred embodiment, the Beta units are scaled so that the temperature compensation is zero when the wash water temperature is about 65 degrees Celsius.

First (box 208) the wash water temperature measurement Temp is checked to see if its value represents a reasonable value (e.g., between 0 and 100 degrees Celsius). If not the temperature compensation calculation is skipped. Otherwise the calculation (box 210) proceeds by: (1) computing the difference X between the temperature and the zero compensation point (Temp=117, for 65 degrees Celsius); (2) computing T, the temperature adjustment to the Beta unit detergent concentration; and (3) adding the temperature adjustment to Betacc.

Next, the measured detergent concentration is rounded down (boxes 212 through 218) to generate a "hysteresis" or guardband effect which counteracts the tendency of the detergent motor to chatter off and on once the target concentration has been reached. This rounding mechanism makes use of the fact that each target value in Beta units corresponds to a five percent range of detergent concentrations. The rounding is designed to keep the detergent motor on until the detergent concentration level reaches the upper half of the range corresponding to the target concentration level. Once this level is reached the detergent motor is kept off until the detergent concentration level falls by at least 2½ percent to next lower Beta unit value. Thus detergent motor chattering is prevented by requiring the measured detergent concentration level to change by at least 2½ percent before the detergent motor is turned either off or on.

The above described "hysteresis" rounding is performed as follows. If the detergent pump feed flag is on (box 212) the Beta unit abscissa is rounded down (boxes 214 through 218).

This is done by calculating (box 214) half the width of the measurement range corresponding to the Beta abscissa B. The, if A−W is less than the lower measurement boundary for the Beta abscissa B (box 216), the Beta abscissa B is decremented (box 218).

The final Beta unit detergent concentration value Betacc is obtained (box 220) by adding the beta abscissa B to the Beta mantissa Betacc.

Finally, the Betacc value is converted to BCD (binary coded decimal) format for display purposes. Betacc is checked to see if it is too low (less than zero-box 222) or too high (greater than 99-Box 206). If so, the BCD format variable, BETA, is set to a corresponding flag value of $FE_{16}$ (box 224) or $FF_{16}$ (box 228). Otherwise, BETA is set equal to the BCD value of Betacc (box 230). Then the routine exits back to entry point A of the EXEC LOOP routine.

Low Detergent Fault Detection

In the preferred embodiment, the depletion of the diswasher's detergent supply is detected by determining if the rate of increase in detergent concentration is sufficient to bring the detergent concentration up to target level in a reasonable period of time (e.g., 2 minutes for batch dishwashers and 5 minutes for conveyorized dishwashers). This is done by collecting a set of ten probe measurement PRB values (one each half second). These values are stored in a memory area called the PRB Stack by the DEBOUNCE routine. Each time a new probe value is added to the PRB Stack, the oldest value in the stack is automatically discarded.

Actually, it should be noted that since four probe measurements are taken during each control cycle, four probe values are added to the stack each time the PRB Stack is updated. During the linear regression calculation described below, only the one probe value corresponding to the currently selected probe range (see boxes 188–202 of the BETACALC routine in FIG. 12) is used and the other three probe values are ignored.

Using the ten accumulated probe values in the PRB Stack, a linear regression is performed to determine if the rate of detergent concentration increase is sufficient to bring the detergent concentration up to the target level within a preselected time period (two minutes for batch and five minutes for conveyorized diswashers). If this test fails continuously for twelve seconds, then a Low Detergent fault alarm is generated. This Low Detergent fault detection mechanism closely matches the concerns of the dishwasher operator—that enough detergent is being fed into the diswasher to clean the dishes therein.

The classical linear regression formula for determining the slope dy/dx of a set of data points (x,y) is $$dy/dx = \frac{n\Sigma xy - \Sigma x \Sigma y}{n\Sigma x^2 - (\Sigma x)^2} \quad \text{(Eq. 1)}$$

where, in this case n=10, each y represents a probe measurement value, and there are ten pairs of (x,y) values with x varying from 0 to 9. Only the Σy and Σxy terms need to be recalculated during each linear regression computation because all the other terms are constants.

Figure 12B:
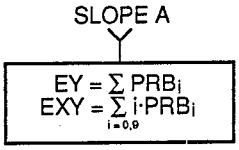

Referring to FIG. 12B, the SLOPEA routine calculates the sums of the y and xy terms, EY and EXY, respectively.

Figure 12C:
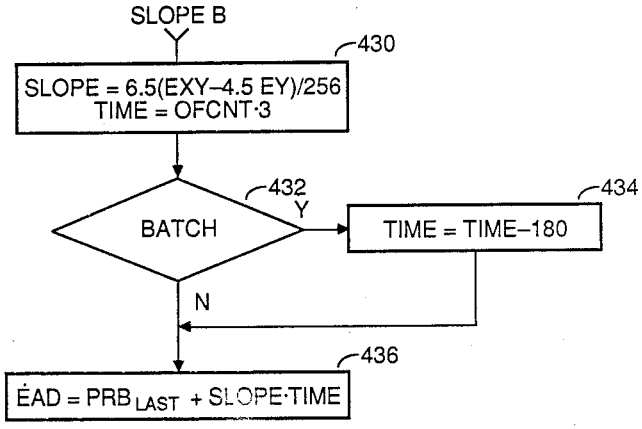

Referring to FIG. 12C, the SLOPEB routine calculates a slope value using the formula $$\text{Slope}=6.5\ (\text{EXY}-4.5\ EY)/256 \quad \text{(Eq. 2)}$$

which is equivalent to equation Eq. 1, above.

Next (boxes 430–434), a Time value is calculated which corresponds to five minutes for conveyorized dishwashers and to two minutes for batch type dishwashers.

Finally, based on the slope calculated, an expected value EAD of the amount of increase in detergent concentration during the next two or five minute time period is calculated (box 436) using the formula:

$$\text{EAD}=\text{PRB}_{last}+\text{Slope*Time} \quad \text{(Eq. 3)}$$

where $\text{PRB}_{last}$ is the last probe measurement value in the selected probe measurement range.

Figure 12D:
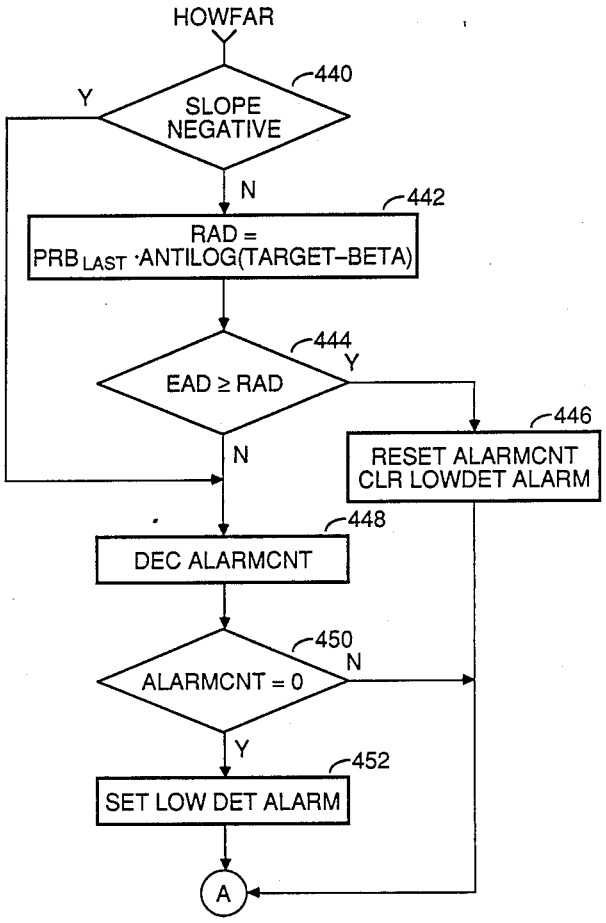

Referring to FIG. 12D, the HOWFAR routine first checks to see if the calculated Slope is negative (box 44). If so, the detergent concentration is decreasing and the low detergent ALARMCNT counter is decremented (box 448). If not, the required increase in detergent concentration RAD in order to reach the target concentration is calculated (box 442) using the formula:

$$RAD = PRB_{last} + Antilog(Target - Betacc) \quad \text{(Eq. 4)}$$

where the Antilog is calculated as follows. For each fourteen beta units, the detergent concentration ***? approximately doubles. Therefore the Analog is calculated by (1) calculating how many times (X) fourteen can be factored into the difference between Target and Betacc; (2) taking the remainder from the previous calculation and using the LogTbl in Table 2, with a base point at EXTBL0, to look up the Antilog of the remainder; and (3) multiplying the value obtained from the table lookup by $2^X$. Restated:

$$Antilog(TB) = 2^{TB/14} * EXTBL0(TB - TB/14) \quad \text{(Eq. 5)}$$

where

TB=Target−Betacc

TB/14=the number of times that 14 can be factored into TB.

Next, RAD is compared to EAD, calculated by the SLOPEB routine. If EAD is greater than or equal to RAD (box 444), then detergent is being added to the wash water at a sufficient rate, and the ALARMCNT counter is reset (to a value of twelve seconds) and the Low Detergent Alarm flag is cleared (box 446). Otherwise, the ALARMCNT counter is decremented (box 448). If the ALARMCNT counter is decremented continually for twelve seconds it will reach a value of zero (box 450) and the Low Detergent Alarm flag will be set (box 452). If the ALARMCNT counter has not yet been decremented to zero the routine exits without setting the Low Detergent Alarm flag.

Time Based Control Decisions

The TIMESTUFF routine, shown in FIG. 13, performs most of the system's time dependent control functions. These control functions are as follows.

Rinse Delay

In batch type diswashers is it possible to conserve rinse agent without reducing the rinse agent's sheeting action by delaying the introduction of rinse agent into the rinse water supply at the beginning of each rinse cycle. The length of the rinse delay is set by the rinse delay pot attached to ADC input port Din6. By using rinse aid during only the end of the rinse cycle, a significant portion of the rinse aid used in prior art models can be saved.

While in batch models the full tray of dishes is generally rinsed simultaneously, in conveyor models the rinse section is typically shorter than a rack of dishes. The rinse cycle in conveyor models begins when a rinse sensor arm in the dishwasher detects the presence of a dish rack moving along the conveyor into the rinse section. Clearly, use of the rinse delay feature in conveyor models would only serve to subject the dishes in the front of the dish rack to less rinse aid than those toward the back. Since this result is not desirable, the rinse delay feature is disabled when the dishwasher is a conveyor model.

Referring now to the flowchart of the TIMESTUFF routine in FIG. 13, the flow of rinse water is detected by reading the C5 input port to the microprocessor 72. If the rinse water is not flowing (box 240), the Rinse Delay counter is reset to the value set by the rinse delay pot and the Rinse Flag is cleared (box 250). If rinse water is flowing the type of dishwasher being used is checked (box 242). If the dishwasher is of the conveyor type, then rinse agent must be used at all times during the rinse cycle and thus the rinse flag is set (box 248) and the routine moves on to the next subsection.

If the dishwasher is a batch type machine then the Rinse Delay counter is decremented (box 244) and tested (box 246). If the rinse delay period is over then the rinse flag is set (box 248); otherwise the routine simply moves on to the next step.

50% Detergent Feed Duty Cycle

Second, a 50% duty cycle counter called Longcnt can be used, if the 50% feed option is enabled (by switch S3 on microprocessor port C2), to slow down the feeding of detergent into the wash water when the detergent concentration level is close to its target level.

The 50% time is simply a flag, called the 50% Flag which toggles on and then off every three seconds. This flag is then used by the DECISIONS routine (see FIGS. 14A and 14B) to affect the feeding of detergent into the dishwasher.

The three second counter is called Longcnt. During each control cycle it is decremented (box 252) and then tested (box 254) to determine if the three second period has expired. If so, the Longcnt counter is reset (to a value of 96, which corresponds to a period of three seconds) and the 50% Flag is toggled (box 256). If not, the process moves to entry point T1 to the low detergent test.

Detergent Overfeed

Third, if the detergent pump has been continuously enabled for five minutes it is assumed that something is wrong (e.g., the detergent feed line is not connected to the wash water tank) and an Overfeed flag is set. The OFCNT counter is set to an initial value of 100 whenever the detergent feed is off, and is decremented every three seconds while the detergent feed is enabled. If OFCNT reaches a value of zero before being reset, an overfeed fault has occurred.

If the Detergent Feed flag is off (box 258), then there cannot be an overfeed flag fault, and the OFCNT counter is set to an initial value of 100 (box 268), corresponding to a "drop dead" overfeed time limit of 5 minutes. If the Detergent Feed flag is on, but the detergent pump is off (box 260) (because of the 50% duty cycle feature), then the procedure exits through entry point T1 to the low detergent test.

If the detergent pump is on, then OFCNT is decremented (box 262) and tested (box 264). If the detergent pump has run for five minutes without reaching its target value, OFCNT will equal zero and the Overfeed Flag is set (box 266) and the OFCNT counter is reset. If an overfeed fault has not yet occurred, then the routine is complete.

In an alternate embodiment of the present invention, the TIMESTUFF routine continues with the following low detergent test. This test is used instead of the the SLOPEA, SLOPEB, and HOWFAR routines described above, and is simpler in design than the low detergent test used in the preferred embodiment.

Low Detergent

The basic method of this alternate low detergent test is that, if during any twelve second period while the detergent pump is enabled the measured detergent concentration does not increase by at least a predefined amount, a low detergent alarm is generated.

The low detergent fault test is run only once very half second, when AVECNT equals sixteen (box 270); otherwise the routine exits back to entry point A of the EXEC LOOP.

The first step of this procedure is to logically AND all the PRBA accumulators with FE in order to zero out the least significant bit of these accumulators (box 272). Then the Detergent Feed flag is tested (box 274). if it is off then the Low Detergent flag is cleared (box 284) and the ALARMCNT counter is reset to a value of 24, which corresponds to 12 seconds.

If the Detergent Feed flag is on, then the next step is to determine if there has been a significant increase in detergent level (box 276). The PRBA value used for this test is the most sensitive measurement (i.e., starting with PRB0) which is less than 158, or PRBA3 if even PRBA2 is greater than 158.

If the test in box 276 is satisfied, the Low Detergent flag is cleared (box 284), and the ALARMCNT counter is reset (box 286). If the test in box 276 is not satisfied, the ALARMCNT counter is decremented (box 278) and tested (box 280). If ALARMCNT equals zero (box 280) the Low Detergent flag is set, thereby indicating that a fault condition has been detected, and the ALARMCNT counter is reset (box 286).

The TIMESTUFF routine finishes up by storing the present PRBA values in an array called OldPRBA (box 288). Further, if the Low Detergent flag is set (box 290), the OldPRBA values are incremented (box 292) to prevent a subsequent single bit increase in one of the PRBA's from resetting the Low Detergent flag.

One problem with this version of the low detergent test was found in a small number of installations using powder detergent feeders. The problem was that when the detergent supply ran out, a small amount of detergent concentrate continued to drip into the wash water tank. This produced enough of an increase in detergent concentration to sufficiently increase the measured wash water conductivity at least once every twelve seconds to prevent the generation of a Low Detergent alarm, but was not sufficient to bring the detergent level up to the target level. While the incidence of this problem was low, the preferred embodiment avoids this problem and provides a more meaningful low detergent test.

DECISIONS

Referring to FIGS. 14A and 14B, the DECISIONS routine is used to turn the Detergent Pump off and on, control the status of the Low Additive and Sanitizer Feed flags, and control the operation of the Beeper. Another feature of the DECISIONS routine is that when the controller (and thus the dishwasher, which is generally connected to the same power supply) is first turned on the detergent pump is disabled for an initial one second delay period. This initial delay period gives the system, and especially the detergent concentration measurement portion of the system, time to stabilize. This helps avoid erroneous enablement of the detergent pump 32, for instance after a brief power interruption.

If the dishwasher is of the batch type (box 300) and it is in a rinse cycle (box 302) then the detergent pump is turned off (box 304) and the process resumes at entry point D1. The purpose of this feature is to prevent detergent overfeed in batch type dishwashers. In batch type dishwashers the wash water pump 42 is turned off during the rinse cycle. Since the agitation of the wash water 35 by the wash water pump 42 is the main mechanism which promotes the quick mixing of detergent into the wash water, if detergent were added when the wash water pump 42 is turned off the detergent would tend to sink to the bottom of the wash water tank without mixing into the wash water. As a result, the conductivity of the wash water would not reflect the amount of detergent actually added and the controller could add too much detergent to the wash water.

If either a conveyor type dishwasher is being used (box 300) or the dishwasher is not in a rinse cycle (box 302), the process continues by testing the DelayCnt counter (box 306). This a one second counter which disables the detergent pump for approximately one second when the system is first turned on. If the delay period is not yet over, DelayCnt is decremented (box 308) and then (boxes 310 and 304) the Detergent Feed flag is cleared, the Low Detergent flag is cleared, the ALARMCNT counter is reset, and the Detergent Pump is turned off.

If the delay period is over, the Overfeed Flag is tested (box 312). If it is set (i.e., if an Overfeed fault has been detected) then the current detergent concentration value BETA is tested (boxes 314 and 316) to see if it is less than the target concentration level. If so, then the process continues at box 310, as described above. If not, the Overfeed flag is cleared and the OFCNT counter is reset (box 318) before the process continues at box 310.

If an overfeed fault has not occurred (box 312), then the current detergent concentration value BETA is tested (boxes 320 and 322) to see if it is less than the target concentration level. If so, the Detergent Feed flag is set (box 326 or 324) and then, except in one special circumstance, the detergent pump is turned on (box 330). The special circumstance occurs if the 50% detergent duty cycle is activated. That is, if the BETA value is not so low as to be out of range (box 320), and the 50% Feed feature is enabled (by switch S3) (box 328), and the 50% Feed Flag is set (box 332), and the current BETA value is within three Beta units of the target (i.e., set) point (box 334), then the detergent pump is turned off (box 304) instead of being turned on.

The next step of the DECISIONS routine is to test the Lo additive input signal on port C6 to the microprocessor 72, which will be active if either the rinse agent supply or the sanitizer supply has been depleted or disconnected from its pump. If the Lo Additive input signal is active (box 336), the Lo Additive flag is set (box 340), otherwise it is cleared (box 338).

Referring to FIG. 14B, the next step is to test the Sanitizer Logic input signal on port C3 to the microprocessor 72 to determine if the Sanitizer pump is connected to the rinse water line or the wash water tank of the dishwasher (box 342). If connected to the rinse line, then if the rinse pump is on (box 344), which is determined by testing the rinse enable signal on port C5 to the microprocessor, the Sanitizer Flag is set (box 346), thereby allowing the Sanitizer Speed routine to turn on the sanitizer pump; otherwise the Sanitizer Flag is cleared (box 350), which causes the sanitizer pump to be turned off. If the Sanitizer pump is connected to the wash water tank, then if the detergent pump is on (box 348) the Sanitizer Flag is set (box 346); otherwise it is cleared (box 350).

Referring to the Beeper Logic portion of FIG. 14B, three distinct Beeper sounds are generated for Overfeed, Low Detergent, and Low Additive faults. If an Overfeed fault has occurred (box 352), the Beeper 66 is turned on steady (box 354).

If no Overfeed fault has occurred, then the controller checks to see if a Low Detergent fault has occurred (box 356). If so, then the Beeper is cycled on and off (boxes 358, 360 and 364) at a rate of 2 hertz. This is done by using the bit b3 (the fourth least significant bit) of the Longcnt counter to control whether the Beeper is turned on or off.

If no Low Detergent fault has occurred, the controller checks for a Low Additive fault (box 362). If one has occurred then the Beeper is cycled on and off (boxes 366, 368 and 364) at a rate of 4 hertz (this time using bit b2 of Longcnt as the Beeper control signal). The DECISIONS routine then exits back to entry point A of the EXEC LOOP routine.

DISPLAY

Referring to FIG. 15, the preferred embodiment of the display 68 includes a two digit seven segment display, plus two labelled LEDs. One of the LEDs is lit when the detergent pump is on; the other LED is lit when either an Overfeed fault or a Low Detergent fault has occurred.

Two registers are used for the display: each uses seven bits to control one of the seven segment display digits, and one bit to control one of the labelled LEDs.

The other LEDs D13, D17 and D15 on the system's front panel, which are labelled RINSE FEED, RINSE LOW, and SANIT LOW, are controlled directly by the corresponding sensors P1, P2 and P3 rather than by the system's microprocessor 72.

Further, the digital portion of the display has four modes of operation: off; display of the wash water temperature in degrees Celsius; display of the detergent concentration in Beta units; and Limits mode for the display of the detergent concentration as either "Lo", "Hi", or "--" (equal to, or within a predefined margin of the target value).

The first step of the DISPLAY routine is to clear the DISPLAY Register (box 278). If left cleared, this will effectively turn off the digital portion of display 68.

Next, the DISPLAY routine checks to see if the target detergent concentration level has been changed by the user (box 379*a*) by comparing the current target value with the value stored in the LastPass buffer. If so, the DISPLAY register is set up so that the new target value is flashed on and off for two seconds (boxes 379*b*–379*f*).

The intermittent display of new detergent concentration target values is accomplished by setting a counter called FlashCnt to a value of 64 and storing the new target value in a buffer called LastPass (box 379*b*). Then the FlashCnt counter is tested to see if its equal to zero (box 379*c*). If so, the target value is no longer displayed and the process continues with the normal display setup process at box 380. Otherwise, FlashCnt is decremented (box 379*d*). If bit 3 of the resulting FlashCnt value is equal to zero, the DISPLAY register is left cleared so that the display is blank, and the process continues at entry point DS to box 414. If bit 3 of FlashCnt is not equal to zero the DISPLAY register is loaded with the new target value (box 379*f*) and the process continues at entry point DS to box 392. Since FlashCnt will be decremented 32 times per second until it reaches a value of zero, the target value will be flashed on and off at a rate of 4 hertz for two seconds.

If the user requests that the wash water temperature be displayed (box 380) by setting the display on/off switch S1 to "off" and by setting the display limit/beta switch S2 to "beta", then the X register is assigned the value of the BCDTEMP variable (box 382), which is equal to the measured wash water temperature in binary coded decimal format.

If X equals the "Lo" flag value $FE_{16}$ (box 384), indicating that the measured wash water temperature was below zero degrees Celsius or that no temperature probe is connected to the ADC 74, then the DISPLAY Register is left empty so that the display is cleared. If X equals the "Hi" flag value $FF_{16}$ (box 388), indicating that the measured temperature was above 100 degrees, then the DISPLAY Register is set so that the message "Hi" is displayed (box 390). In either case the process then continues at entry point DS to box 414.

If X represents a value between 0 and 99, then the DISPLAY Register is set to display the digital value of X (box 392).

If the display in not in temperature mode (box 380), then X is assigned the value of BETA (box 394), which equals the measured detergent concentration level in Beta units in binary coded decimal format.

Next, if the display on/off switch S1 is set to "off", then the routine exits through entry point DS to the last step of the DISPLAY routine. Otherwise the display limits/beta switch S2 is tested to determine if the display is in Limits mode (box 398). If the display is not in Limits mode, then X is compared with the "Lo" flag value (box 399). If X equals the "Lo" flag, the DISPLAY Register is set so that the message "Lo" is displayed (box 386). If not, the process continues at box 388 as described above (except that X now represents Beta units of detergent concentration instead of wash water temperature in degrees Celsius).

If the display is in Limits mode, then the DISPLAY routine continues as follows. If X equals the "Lo" flag value $FE_{16}$ (box 400), indicating that the measured detergent concentration was less than zero Beta units, then the DISPLAY Register is set so that the message "Lo" is displayed (box 386). If X equals the "Hi" flag value $FF_{16}$ (box 388), indicating that the measured detergent concentration was above 99 Beta units, then the DISPLAY Register is set so that the message "Hi" is displayed (box 390).

If X represents a value between 0 and 99, then X is compared with the target concentration level. If X is above the target plus a margin of three Beta units, then the DISPLAY Register is set so that the message "Hi" is displayed (box 390). If X is within a predefined margin of the target, i.e., within one Beta unit below to three Beta units above target (box 410), the DISPLAY Register is set so that the message "--" is displayed (box 412); otherwise, if X is less than the target minus a margin of one beta unit the DISPLAY Register is set so that the message "Lo" is displayed (box 386).

The final step of the DISPLAY routine is to update the LED bits (box 414) to accurately represent whether the detergent pump is on, and whether either an Overfeed or Low Detergent fault has occurred.

DEBOUNCE

The DEBOUNCE routine (shown in the FIG. 16) reads the A and C ports inputs to the microprocessor 72 (box 420). Only when the same input values are read eight times in a row (i.e., the signals are steady for 0.25 seconds) are these input values accepted as valid for use by the rest of the control program (boxes 422 and 424). Thus, fluctuations in these input signals, which can occur when the value of one these signals changes, are filtered out, or "debounced".

The DEBOUNCE routine also pulses the STROBE port of the Serial Interface (SI) to mark the beginning of each new data record transmitted to the Serial Interface by the DIGITAL routines; and the ADC's chip enable (CE) port is pulsed off and on to insure that the ADC 74 is synchronized with the eight-pulse I/O Clock signal generated by the microprocessor 72 for use by the ADC 74.

As an adjunct to the BETAUNIT routine, the DEBOUNCE routine stores the current probe measurement values in the PRB stack (box 428) for use by the low detergent test routines, and clears the probe accumulator registers (PRBA's), if the AVECNT counter indicates that the BETACALC routine has already processed the current probe measurement values (box 426).

CONCLUSION

While the present invention has been described with reference to a few specific embodiments, the description is illustrative of the invention and is not to be construed as limiting the invention. Various modifications may occur to those skilled in the art without departing from the true spirit and scope of the invention as defined by the appended claims.

TABLE I

ROUTINE JUMP TABLE

| COUNT/2 | ROUTINE |
|---|---|
| 32 | ANASET (3) |
| 31 | PROBE (3) |
| 30 | PROBE (2) |
| 29 | PROBE (1) |
| 28 | PROBE (0) |
| 27 | ANASET (9) |
| 26 | RINSESPEED |
| 25 | - NULL - |
| 24 | ANASET (10) |
| 23 | SANITSPEED |
| 22 | - NULL - |
| 21 | ANASET (8) |
| 20 | SANIPOT = POT (8) |
| 19 | RINSEPOT = POT (7) |
| 18 | RDLYPOT = POT (6) |
| 17 | BATCH/CONV = POT (5) |
| 16 | TEMPCO |
| 15 | PROBE (3) |
| 14 | PROBE (2) |
| 13 | PROBE (1) |
| 12 | PROBE (0) |
| 11 | BETAUNIT/DETRGNT ALARM |
| 10 | - NULL - |
| 9 | - NULL - |
| 8 | DEBOUNCE |
| 7 | DECISIONS |
| 6 | DISPLAY |
| 5 | DIGITAL (1) (BETA) |
| 4 | DIGITAL (2) (BCDTEMP) |
| 3 | DIGITAL (3) (Beta target) |
| 2 | DIGITAL (4) (FlagReg) |
| 1 | TIMESTUFF |

TABLE II

LOGARITHMIC BETA LOOKUP TABLE

| | BETA VALUE | PROBE MEASUREMENT |
|---|---|---|
| EXTBL0: | −1 | 34 |
| | 0 | 36 |
| | 1 | 38 |
| | 2 | 40 |
| | 3 | 42 |
| | 4 | 44 |
| | 5 | 46 |
| | 6 | 49 |
| | 7 | 51 |

TABLE II-continued

LOGARITHMIC BETA LOOKUP TABLE

| BETA VALUE | PROBE MEASUREMENT |
|---|---|
| 8 | 54 |
| 9 | 56 |
| 10 | 59 |
| 11 | 62 |
| 12 | 65 |
| 13 | 68 |
| 14 | 72 |
| 15 | 75 |
| 16 | 79 |
| 17 | 83 |
| 18 | 87 |
| 19 | 92 |
| 20 | 96 |
| 21 | 101 |
| 22 | 106 |
| 23 | 111 |
| 24 | 117 |
| 25 | 123 |
| 26 | 129 |
| 27 | 135 |
| 28 | 142 |
| 29 | 149 |
| 30 | 157 |
| 31 | 164 |
| 32 | 173 |
| 33 | 181 |
| 34 | 190 |
| 35 | 200 |
| 36 | 210 |
| 37 | 220 |
| 38 | 231 |
| 39 | 243 |
| 40 | 255 |

What is claimed is:

1. In a dishwasher system having conductivity measuring means for measuring the conductivity of wash water used by said system, a detergent dispenser for adding detergent to wash water used by said system, and a rinse agent dispenser for adding rinse agent to rinse water used by said system, a dispenser controller coupled to said conductivity measuring means, detergent dispenser and rinse agent dispenser comprising:

concentration selection means for selecting a target dish water detergent concentration level which is calibrated in predefined logarithmically scaled units providing proportionally uniform resolution over a predefined range of selectable concentration levels;

comparison means for converting the conductivity measurements obtained by said conductivity means into detergent concentration measurements calibrated in said predefined logarithmically scaled units, and for comparing said target concentration level with said detergent concentration measurements; and detergent dispenser control means, responsive to said comparison means, for turning said detergent dispenser on and off in response to the relative levels of said detergent concentration measurements and said target dish water detergent concentration level;

whereby said concentration selection means can be used to select target concentration levels with substantially uniform accuracy over a wide range of concentration levels.

2. The dispenser controller of claim 1, wherein said dishwasher system includes a wash water tank for mixing detergent with wash water, and said detergent dispenser includes means for dispensing detergent into said wash water tank;

said dispenser controller includes dishwasher type selection means for specifying whether said dishwasher system is a batch or conveyor mode dishwasher system; and said detergent dispenser control means includes logic means, responsive to an indication from said dishwasher type selection means that said dishwasher system is a batch mode dishwasher system, for preventing the dispensing of detergent into the wash water tank of said dishwasher system during rinse cycles even when said detergent concentration measurements from said comparison means are less than said selected target dish water detergent concentration level.

3. A dispenser controller as in claim 1, said range of selectable concentration levels including maximum and minimum selectable concentration levels with a ratio of at least 20:1.

4. In a dishwasher system having conductivity measuring means for measuring the conductivity of wash water used by said system, a detergent dispenser for adding detergent to wash water used by said system, and a rinse agent dispenser for adding rinse agent to rinse water used by said system, a dispenser controller coupled to said conductivity measuring means, detergent dispenser and rinse agent dispenser comprising:

concentration selection means for selecting a target dish water detergent concentration level which is calibrated in predefined logarithmically scaled units providing proportionally uniform resolution over a predefined range of selectable concentration levels;

comparison means for converting the conductivity measurements obtained by said conductivity means into detergent concentration measurements calibrated in said predefined logarithmically scaled units, and for comparing said target concentration level with said detergent concentration measurements; and detergent dispenser control means, responsive to said comparison means, for turning said detergent dispenser on and off in response to the relative levels of said detergent concentration measurements and said target dish water detergent concentration level; and means for determining the rate of increase of said detergent concentration measurements, and means for denoting a detergent feeding failure when said rate of increase remains, for a first predefined period of time, less than the rate required to increase said detergent concentration to said target dish water detergent concentration level within a second predefined period of time; wherein said first predefined period of time is shorter than said second predefined period of time;

whereby a detergent feeding failure can be quickly detected by detecting when the rate of increase of detergent concentration is too low to reach said specified target level.

5. In a dishwasher system having water routing means for receiving wash water and rinse water to be used by said system, ion concentration measuring means for measuring the conductivity of the wash water used by said system, a detergent dispenser for adding detergent to the wash water used by said system, and a rinse agent dispenser for adding rinse agent to the rinse water used by said system, a controller comprising:

concentration selection means for selecting a target dish water detergent concentration level which is calibrated in predefined logarithmically scaled units, wherein each logarithmically scaled unit corresponds to a predefined percentage change in the conductivity of said system's wash water;

comparison means for comparing said target concentration level with the conductivity level measured by said ion concentration measuring means;

dishwasher type selection means for specifying whether said dishwasher system is a batch or conveyor mode dishwasher system; and logic means, responsive to an indication from said dishwasher type selection means that said dishwasher system is a batch mode dishwasher system, for preventing the dispensing of detergent into the wash water used by said system during rinse cycles even when the conductivity level measured by said ion concentration measuring means is less than said selected target concentration level level, and for limiting the dispensing of rinse agent to a predefined portion of said system's rinse cycle.

6. The controller of claim 5, wherein said logic means for limiting the dispensing of rinse agent includes means for delaying the dispensing of rinse agent for a predefined time period during rinse cycles when said dishwasher type selection means indicates that said dishwasher system is a batch mode dishwasher system, and means for allowing the dispensing of rinse agent whenever rinse water is being used when said dishwasher type selection means indicates that said dishwasher system is a conveyor mode dishwasher system.

7. In a dishwasher system having means for receiving wash water to be used by said system, ion concentration measuring means for measuring the conductivity of the wash water used by said system, and a detergent dispenser for adding detergent to the system's wash water, a detergent dispenser controller including:

means for specifying a target dish water conductivity level; and detergent feeding failure detection means for determining the rate of increase of said conductivity level measured by said ion concentration measuring means, and for denoting a detergent feeding failure when said rate of increase remains, for a first predefined period of time, less than the rate required to increase said conductivity level to said target conductivity level within a second predefined period of time; wherein said first predefined period of time is shorter than said second predefined period of time;

whereby a detergent feeding failure can be quickly detected by detecting when the rate of increase of the wash water conductivity is too low to reach said specified target level within a predetermined amount of time.

8. In a dishwasher controller for controlling the dispensing of chemicals into an industrial dishwasher having a wash water tank for mixing detergent with wash water, a detergent dispenser for dispensing detergent into the wash water tank, means for receiving rinse water to be used by said dishwasher, and a rinse agent dispenser for dispensing rinse agent into the rinse water used by said dishwasher, the improvement comprising:

dishwasher type selection means for specifying whether said dishwasher is a batch or conveyor mode dishwasher; and logic means, responsive to an indication from said dishwasher type selection means that said dishwasher is a batch mode dishwasher, for preventing the dispensing of detergent into said wash water tank during rinse cycles and for delaying the dispensing of rinse agent for a predefined time period during rinse cycles.

* * * * *